US008551264B2

(12) United States Patent
Kosaka et al.

(10) Patent No.: US 8,551,264 B2
(45) Date of Patent: Oct. 8, 2013

(54) METHOD FOR THE MANUFACTURE OF ALPHA-BETA TI-AL-V-MO-FE ALLOY SHEETS

(75) Inventors: Yoji Kosaka, Henderson, NV (US); Phani Gudipati, Henderson, NV (US)

(73) Assignee: Titanium Metals Corporation, Exton, PA (US)

( * ) Notice: Subject to any disclaimer, the term of this patent is extended or adjusted under 35 U.S.C. 154(b) by 0 days.

(21) Appl. No.: 13/525,323

(22) Filed: Jun. 17, 2012

(65) Prior Publication Data

US 2013/0000799 A1 Jan. 3, 2013

Related U.S. Application Data

(60) Provisional application No. 61/498,447, filed on Jun. 17, 2011.

(51) Int. Cl.
*C22F 1/18* (2006.01)
*C22C 14/00* (2006.01)

(52) U.S. Cl.
USPC ..... 148/670; 148/421; 420/420

(58) Field of Classification Search
USPC ..... 148/670, 421; 420/420
See application file for complete search history.

(56) References Cited

U.S. PATENT DOCUMENTS 4,563,239 A * 1/1986 Adinolfi et al. ..... 216/91
5,718,779 A 2/1998 Fukai et al.
6,053,993 A 4/2000 Reichman et al.
6,232,573 B1 * 5/2001 Fukai et al. ..... 219/121.14
6,786,985 B2 9/2004 Kosaka et al.
7,708,845 B2 5/2010 Tetyukhin et al.
2003/0168138 A1 9/2003 Marquardt
2005/0051245 A1 3/2005 Fukai et al.
2006/0189406 A1 8/2006 Ogawa
2007/0007281 A1 1/2007 Tetyukhin et al.
2012/0160084 A1 6/2012 Mosser

OTHER PUBLICATIONS

International Search Report for International Application No. PCT/US12/42845—Date of Completion of Search: Aug. 16, 2012; mailed on Sep. 4, 2012; 2 pages.
Written Opinion of the International Searching Authority for International Application No. PCT/US12/42845—Date of Completion of Search: Aug. 16, 2012; mailed on Sep. 4, 2012; 4 pages.

(Continued)

*Primary Examiner* — Jessee Roe
(74) *Attorney, Agent, or Firm* — Locke Lord LLP; Brandon Schurter; Peter J. Fallon

(57) ABSTRACT

A method of manufacturing fine grain titanium alloy sheets that is suitable for superplastic forming (SPF) is disclosed. In one embodiment, a high strength titanium alloy comprising: Al: about 4.5% to about 5.5%, V: about 3.0% to about 5.0%, Mo: about 0.3% to about 1.8%, Fe: about 0.2% to about 0.8%, O: about 0.12% to about 0.25% with balance titanium is forged and hot rolled to sheet bar, which is then fast-cooled from a temperature higher than beta transus. According to this embodiment, the sheet bar is heated between about 1400° F. to about 1550° F. and rolled to intermediate gage. After reheating to a temperature from about 1400° F. to about 1550° F., hot rolling is performed in a direction perpendicular to the previous rolling direction to minimize anisotropy of mechanical properties. The sheets are then annealed at a temperature between about 1300° F. to about 1550° F. followed by grinding and pickling.

10 Claims, 26 Drawing Sheets

(56) References Cited

OTHER PUBLICATIONS

Combres, Y. et al., "Comparison of the β-CEZ and Ti-64 Superplastic Properties", Titanium '95: Science and Technology, pp. 864-871 (1995).
Fukai, H. et al., "Hot Forming Characteristics of SP-700 Titanium Alloy", in Ti2003 Science and Technology, Eds. C. Lutjering, et al., published by DCM, pp. 635-642 (2003).
Gershon, B. et al., "Superplastic Sheet Forming of Aircraft Parts from Ti-alloys", Ti-2007 Science and Technology, Eds. M. Ninomi, et al., The Japan Institute of Metals, 2007, pp. 1287-1289 (2007).
Hefti, L., "Elevated Temperature Fabrication of Titanium Aerospace Components", Key Engineering Materials vol. 433, Trans Tech Publications, pp. 49-55 (2010).
Inagaki, H., "Mechanism of Enhanced Superplasticity in Thermomechanically Processed Ti-6Al-4V", Z. Metallkd. 87, pp. 179-186 (1996).
Kosaka, Y. et al., "Superplastic Forming Properties of TIMETAL® 54M (Ti-5%Al-4%V-0.6%Mo-0.4%Fe) Sheets", Key Engineering Materials vol. 433, pp. 311-317 (2010).
Kosaka, Y. et al., "Development of Low Cost High Strength Alpha/Beta Alloy with Superior Machinability", in Ti2003 Science and Technology, Eds. C. Lutjering, et al, published by DCM, pp. 3027-3034 (2003).
Levin, I. et al., "Strain Characteristics of Ti6A14V Alloy Super Fine Grain Sheets under SPF Conditions", in Ti2003 Science and Technology, Eds. C. Lutjering, et al, published by DCM, pp. 577-580 (2003).
Mahoney, M. et al., "Technical Note 5A: Superplastic Forming of Titanium Alloys", in Materials Properties Handbook—Titanium Alloys, Eds. R. Boyer, et al., published by ASM International, pp. 1101-1109 (1994).
Mukherjee, A., "The Rate Controlling Mechanism in Superplasticity", Materials Science and Engineering, American Society for Metals, pp. 83-89 (1971).
Paton, N. et al., "Superplasticity in Titanium Alloys", in Titanium Science and Technology, Eds. G. Lutjering, et al., published by Deutsche Gesellschaft fur Metallkunde E.V., pp. 649-672 (1984).
Poorganji, B. et al., "Effect of Alloying Elements on Hot Deformation of Duplex Titanium Alloys", Ti-2007 Science and Technology, The Japan Institute of Metals, pp. 535-538 (2007).
Ridley, N. et al., "Diffusion Bonding of a Superplastic Near-Alpha Titanium Alloy", Titanium '95: Science and Technology, pp. 604-611 (1995).
Salishchev, G. et al., "Production of Submicron-Grained Ti-6Al-4V Sheets with Enhanced Superplastic Properties", in Ti2003 Science and Technology, Eds. C. Lutjering, et al, published by DCM, pp. 569-576 (2003).
Sargent, G. et al., "Low-Temperature Coarsening and Plastic Flow Behavior of an Alpha/Beta Titanium Billet Material with an Ultrafine Microstructure", Metallurgical and Materials Transactions A, vol. 39A, pp. 2949-2964 (2008).
Semiatin, S. et al., "Constitutive Modeling of Low-Temperature Superplastic Flow of Ultrafine Ti-6A1-4V Sheet Material", Key Engineering Materials vol. 433, pp. 235-240 (2010).
Swale, W. et al., "Applying Superplastic Forming Principles to Titanium Sheet Metal Forming Problems", in Ti2003 Science and Technology, Eds. C. Lutjering, et al, published by DCM, pp. 581-588 (2003).
Tisler, R. et al., "Advanced Superplastic Titanium Alloys", in Titanium '85: Science and Technology, pp. 596-603 (1995).
Tuffs, M. et al., "Effect of alloying element modification on superplastic deformation properties of Ti-4Mo-4Al-2Sn-0-5Si (IMI550)", Materials Science and Technology, vol. 15, pp. 1154-1166 (1999).

* cited by examiner

METHOD FOR THE MANUFACTURE OF ALPHA-BETA TI-AL-V-MO-FE ALLOY SHEETS

This application claims priority under 35 U.S.C. §119(e) to U.S. Provisional Patent Application No. 61/498,447 which was filed on Jun. 17, 2011, the entirety of which is incorporated by reference as if fully set forth in this specification.

BACKGROUND

Most α/β titanium alloys show superplasticity, i.e., elongation larger than 500%, at sub-transus temperatures when deformed with slower strain rates. The temperature and the strain rate at which superplasticity occurs vary depending on alloy composition and microstructure[1]. An optimum temperature for superplastic forming (SPF) ranges from 1832° F. (1000° C.) to as low as 1382° F. (750° C.) in α/β titanium alloys[2]. SPF temperatures and beta transus temperatures show a fairly good correlation if other conditions are the same[2].

On the production side, there are significant benefits arising from lowering SPF temperatures. For example, lowering the SPF temperature can result in a reduction in die costs, extended life and the potential to use less expensive steel dies[7]. Additionally, the formation of an oxygen enriched layer (alpha case) is suppressed. Reduced scaling and alpha case formation can improve yields and eliminate the need for chemical milling. In addition, the lower temperatures may suppress grain growth thus maintaining the advantage of finer grains after SPF operations[8,9].

Grain size or particle size is one of the most influential factors for SPF since grain boundary sliding is a predominant mechanism in superplastic deformation. Materials with a finer grain size decrease the stress required for grain boundary sliding as well as SPF temperatures[2-4]. The effectiveness of finer grains in lowering SPF temperatures was previously reported in Ti-6Al-4V and other alloys[5,6].

There are two approaches for improving superplastic formability of titanium alloys. The first approach is to develop a thermo-mechanical processing that creates fine grains as small as 1 to 2 μm or less to enhance grain boundary sliding. Deformation at lower temperature than conventional hot rolling or forging was studied and an SPF process was developed for Ti-64[5,6].

The second approach is to develop a new alloy system that shows superplasticity at a lower temperature with a higher strain rate. There are several material factors that enhance superplasticity at lower temperatures[1], such as (a) alpha grain size, (b) volume fraction and morphology of two phases, and (c) faster diffusion to accelerate grain boundary sliding[11,16]. Therefore, an alloy having a lower beta transus has a potential to exhibit low temperature superplasticity. A good example of an alloy is SP700 (Ti-4.5Al-3V-2Mo-2Fe) that exhibits superplasticity at temperatures as low as 1400° F. (760° C.)[8]. FIG. 1 shows the relationship between beta transus and reported SPF temperatures[1,7,9,12,16-20]. As a general trend, low beta transus alloys exhibit lower temperature superplasticity. Since Ti-54M has lower beta transus and contains Fe as a fast diffuser, it is expected that the alloy exhibits a lower temperature superplasticity with a lower flow stress than Ti-64. Thus, it may be possible to achieve satisfactory superplastic forming characteristics at low temperature in this alloy without resorting to special processing methods necessary to achieve very fine grain sizes.

Ti-6Al-4V (Ti-64) is the most common alloy in practical applications since the alloy has been well-characterized.

However, Ti-64 is not considered the best alloy for SPF since the alloy requires higher temperature, typically higher than 1607° F. (875° C.), with slow strain rates to maximize SPF. SPF at a higher temperature with a lower strain rate results in shorter die life, excessive alpha case and lower productivity.

Ti-54M, developed at Titanium Metals Corporation, exhibits equivalent mechanical properties to Ti-6Al-4V in most product forms. Ti-54M shows superior machinability, forgeability, lower flow stress and higher ductility to Ti6Al-4V[10]. In addition, it has been reported that Ti-54M has superior superplasticity compared to Ti-6Al-4V, which is the most common alloy in this application[2]. This result is due partly to chemical composition of the alloy as well as a finer grain size which is a critical factor that enhances superplasticity of titanium materials.[21]

The conventional processing method of titanium alloys is shown in FIG. 2A. First, sheet bar is hot rolled to intermediate gages after heating at about 1650° F. (900° C.) to about 1800° F. (982° C.). Typical gages of intermediate sheets are about 0.10" to about 0.60". The intermediate sheets are then heated to about 1650° F. (900° C.) to about 1800° F. (982° C.), followed by hot rolling to final sheets. Typical gages of final sheets are about 0.01" (0.25 mm) to about 0.20" (5 mm). Upon final hot cross-rolling, sheets may be stacked in steel pack to avoid excessive cooling during rolling. After rolling to final gage, the sheets are annealed at about 1300° F. (704° C.) to about 1550° F. (843° C.) followed by air cooling. The last stage of the process is to grind and pickle surface to remove alpha case on the surface formed during thermo-mechanical processing.

A method for manufacturing thin sheets of high strength titanium alloys (primarily for Ti6Al-4V) was previously studied by VSMPO in U.S. Pat. No. 7,708,845 and is shown in FIG. 2B.[22] U.S. Pat. No. 7,708,845 requires hot rolling at very low temperatures to obtain fine grains to achieve low temperature superplasticity. The method disclosed in U.S. Pat. No. 7,708,845 can be achieved with rolling mills with very high power, which often lacks flexibility to meet the requirement of a small lot with a variety of gages.[22] The process described in U.S. Pat. No. 7,708,845 is given in the figure as a comparison. In U.S. Pat. No. 7,708,845, rolling is performed at very low temperatures, which may cause excessive mill load, therefore limit the applicability.

Thus, there is a need in the industry to provide a new method for manufacturing titanium alloys that has greater applicability compared to the conventional and prior art methods.

REFERENCES

[1] N. E. Paton and C. H. Hamilton: in Titanium Science and Technology, edited by G. Lutjering et. al., published by Deutsche Gesellschaft fur Metallkunde E.V., 1984, pp. 649-672

[2] Y. Kosaka and P. Gudipati, Key Engineering Materials, 2010, 433: pp. 312-317

[3] G. A. Sargent, A. P. Zane, P. N. Fagin, A. K. Ghosh, and S. L. Semiatin, Met. and Mater. Trans. A, 2008, 39A; pp. 2949-2964

[4] S. L. Semiatin and G. A. Sargent, Key Engineering Materials, 2010, 433: pp. 235-240

[5] G. A. Salishchev, O. R. Valiakhmetov, R. M. Galeyev and F. H. Froes, in Ti2003 Science and Technology, edited by C. Lutjering et. al., published by DCM, 2003, pp. 569-576

[6] I. V. Levin, A. N. Kozlov, V. V. Tetyukhin, A. V. Zaitsev and A. V. Berestov, ibid, pp. 577-580

(7)B. Giershon and I. Eldror, in Ti2007 Science and Technology, edited by M. Ninomi et. al., JIS publ, 2007, pp. 1287-1289

(8)H. Fukai, A. Ogawa, K. Minakawa, H. Sata and T. Tsuzuji, in Ti2003 Science and Technology, edited by C. Lutjering et. al., published by DCM, 2003, pp. 635-642

(9)W. Swale and R. Broughton, in Ti2003 Science and Technology, edited by C. Lutjering et. al., published by DCM, 2003, pp. 581-588

(10)Y. Kosaka, J. C. Fanning and S. Fox, in Ti2003 Science and Technology, edited by C. Lutjering et. al., published by DCM, 2003, pp. 3027-3034

(11)B. Poorganji, T. Murakami, T. Narushima, C. Ouchi and T. Furuhara, in Ti2007 Science and Technology, edited by M. Ninomi et al, published by JIM, 2007, pp. 535-538

(12)M. Tuffs and C. Hammond, Mater. Sci. and Tech., 1999, 15: No. 10, pp. 1154

(13)H. Inagaki, Z. Metalkd, 1996, 87: pp. 179-186

(14)L. Hefty, Key Engineering Materials, 2010, 433: pp. 49-55

(15)N. Ridley, Z. C. Wand and G. W. Lorimer, in Titanium '95 Science and Technology, pp. 604-611

(16)M. Tuffs and C. Hammond: Mater. Sci. and Tech., vol. 15(1999), No. 10, p. 1154

(17)R. J. Tisler and R. L. Lederich: in Titanium '95 Science and Technology, p. 598

(18)Y. Combres and J-J. Blandin, ibid, p. 598

(19)in Materials Properties Handbook—Titanium Alloys, edited by R. Boyer et. al., published by ASM International, 1994, p. 1101

(20)G. A. Sargent, A. P. Zane, P. N. Fagin, A. K. Ghosh, and S. L. Semiatin: Met. and Mater. Trans. A, vol. 39A, 2008, p. 2949

(21)"Superplastic Forming Properties of TIMETAL® 54M" Key Engineering Materials, 433(2010), pp. 311

(22)U.S. Pat. No. 7,708,845 B2

(23)A. K. Mukherjee: Mater. Sci. Eng., vol. 8 (1971), p. 83

(24)H. Inagaki: Z. Metalkd, vol. 87(1996), p. 179

SUMMARY OF THE INVENTION

The present disclosure is directed to a method of manufacturing titanium alloy sheets that are capable of low temperature SPF operations. The present method is achieved by the combination of a specified alloy chemistry and sheet rolling process. The method includes the steps of (a) forging a titanium slab to sheet bar, intermediate gage of plates; (b) heating the sheet bar to a temperature higher than beta transus, followed by cooling; (c) heating the sheet bar, then hot rolling to an intermediate gage; (d) heating the intermediate gage, then hot rolling to a final gage; (e) annealing the final gage, followed by cooling; and (f) grinding the annealed sheets, followed by pickling.

In a preferred embodiment (shown in FIG. 2C), the method of producing fine grain titanium alloy sheets through a hot rolling process comprises, a. forging titanium slab to sheet bar, intermediate gage of plates;

b. heating the sheet bar to a temperature between about 100° F. (37.8° C.) to about 250° F. (121° C.) higher than beta transus for 15 to 30 minutes followed by cooling;

c. heating the sheet bar to a temperature between about 1400° F. (760° C.) to about 1550° F. (843° C.) then hot rolling to an intermediate gage;

d. heating the intermediate gage to a temperature between about 1400° F. (760° C.) to about 1550° F. (843° C.) then hot rolling to a final gage;

e. annealing the final gage to a temperature between about 1300° F. (704° C.) to about 1550° F. (843° C.) for about 30 min to about 1 hour followed by cooling; and f. grinding the annealed sheets with a sheet grinder followed by pickling to remove oxides and alpha case formed during thermo-mechanical processing.

In one embodiment, the titanium alloy is Ti-54M, which has been previously described in U.S. Pat. No. 6,786,985 by Kosaka et al. entitled "Alpha-Beta Ti—Al—V—Mo—Fe Alloy", which is incorporated herein in its entirety as if fully set forth in this specification.

DETAILED DESCRIPTION

Figure 1:
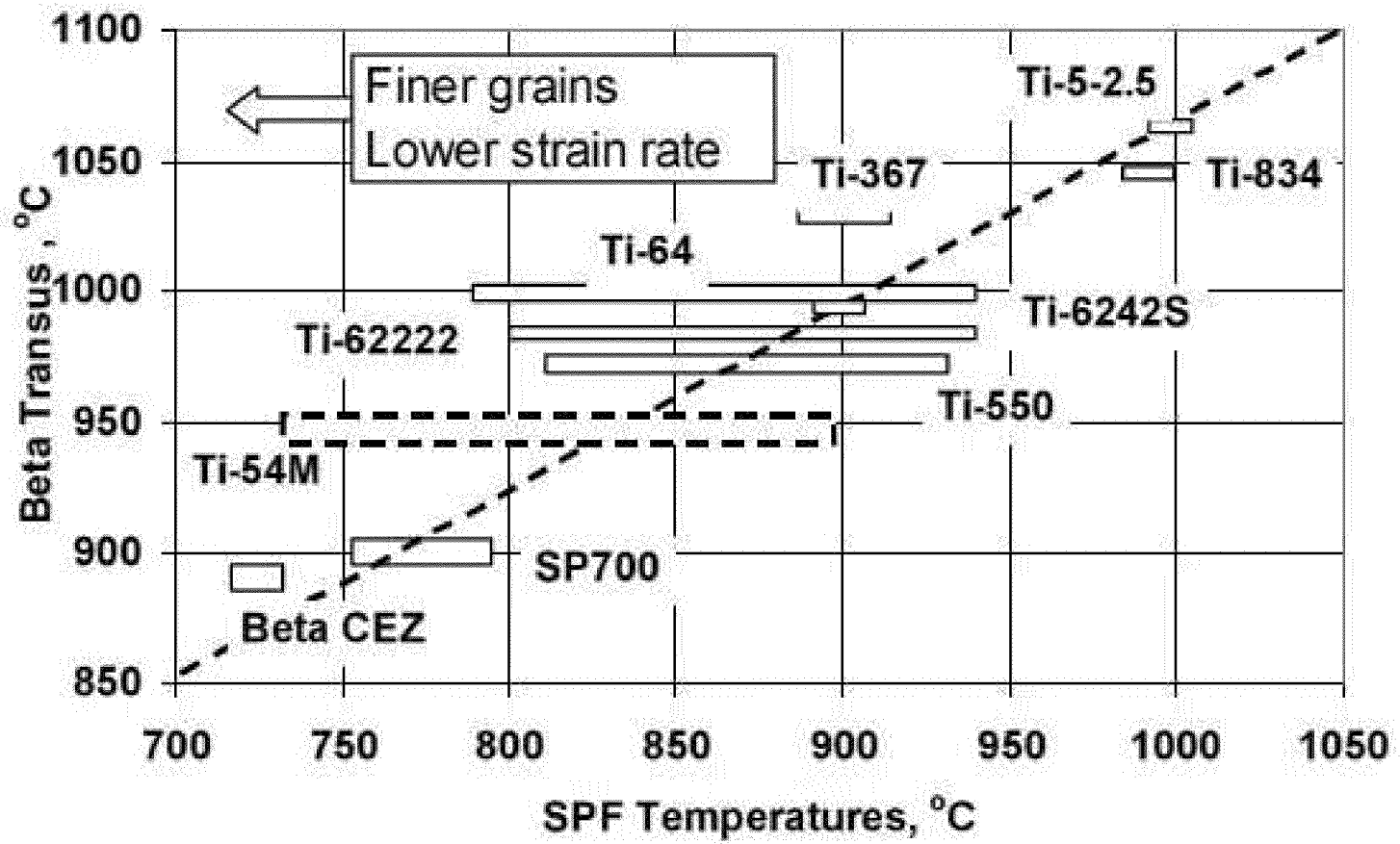
FIG. 1. Schematic showing the relationship between the beta transus and SPF temperature for selected commercial alloys.
Figures 2A, 2B, 2C:
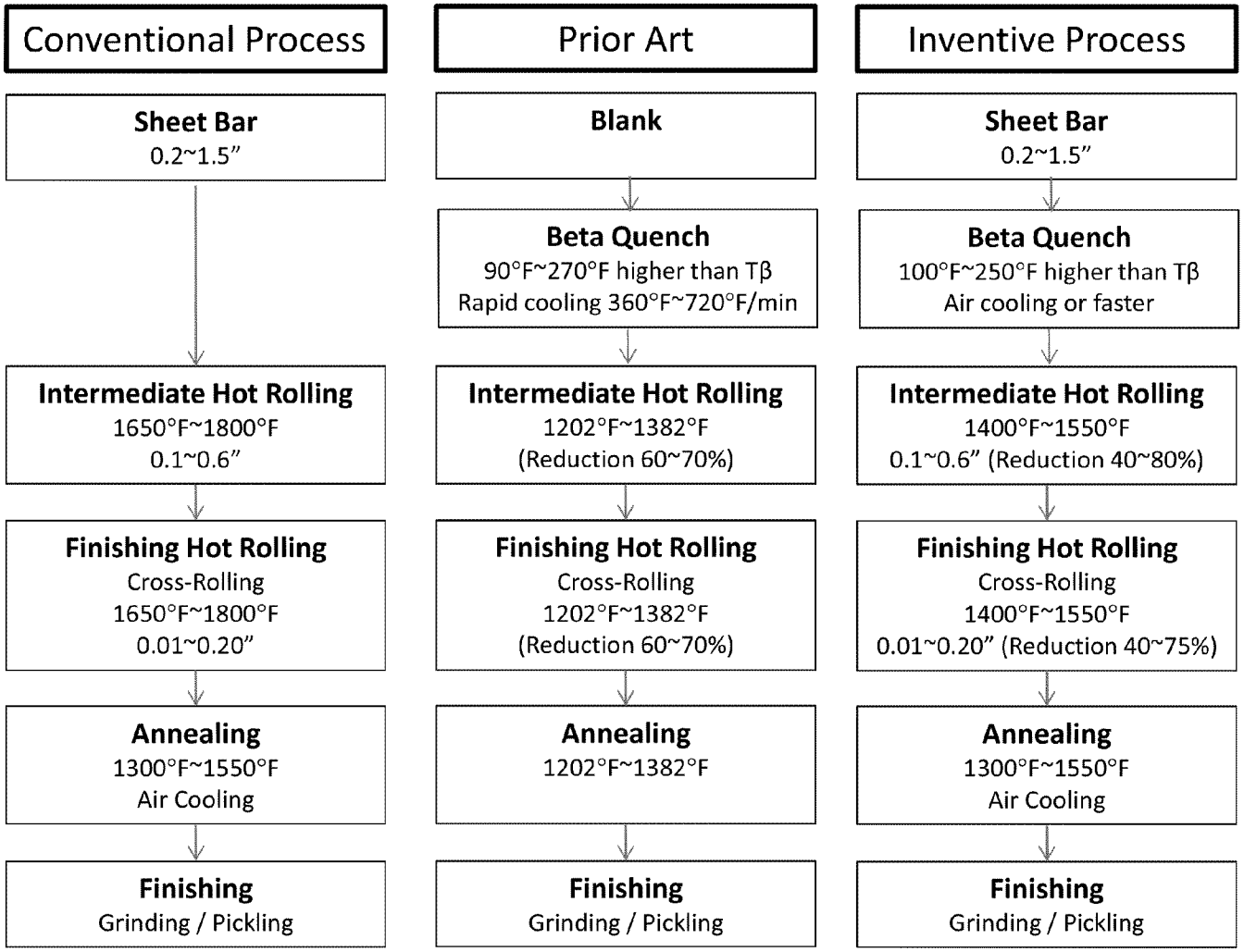
FIG. 2A. Sheet processing steps of conventional route.
FIG. 2B. Sheet processing steps of a prior art process to produce fine grain sheets.
FIG. 2C. Sheet processing step of the disclosed process to produce fine grain sheets.

The present disclosure is directed to a method of manufacturing titanium alloy sheets that are capable of low temperature SPF operations. The present method is achieved by the combination of a specified alloy chemistry and sheet rolling process. The method includes the steps of a. forging a titanium slab to sheet bar, intermediate gage of plates;
b. heating the sheet bar to a temperature higher than beta transus, followed by cooling;
c. heating the sheet bar, then hot rolling to an intermediate gage;
d. heating the intermediate gage, then hot rolling to a final gage;
e. annealing the final gage, followed by cooling; and
f. grinding the annealed sheets, followed by pickling.

Step A—Sheet Bar

In a preferred embodiment, the sheet bar of step (a) has a thickness from about 0.2" (0.51 cm) to about 1.5" (3.8 cm) depending on the finish sheet gages. In variations of this embodiment, the sheet bar of step (a) can be about 0.2", about 0.3", about 0.4", about 0.5", about 0.6", about 0.7", about 0.8", about 0.9", about 1.0", about 1.1", about 1.2", about 1.3", about 1.4", about 1.5", or any increment in between. The thickness of the sheet bar in step (a) is typically chosen based on the thickness of the desired final gage.

Step B—Beta Quench

In a preferred embodiment, the heating of the sheet bar in step (b) is performed at a temperature between about 100° F. (37.8° C.) to about 250° F. (121° C.) higher than beta transus. In a variation of this embodiment, the heating step is performed at a temperature between about 125° F. (51.7° C.) to about 225° F. (107° C.) higher than beta transus. In other variations the heating step is performed at a temperature between about 150° F. (65.6° C.), about 200° F. (93.3° C.) higher than beta transus. In a specific embodiment, the heating step is performed at a temperature at about 175° F. (79.4° C.) higher than beta transus.

In a preferred embodiment, the heating of the sheet bar in step (b) is heated for about 15 to about 30 minutes. In a variation of this embodiment, the sheet bar is heated for about 20 minutes. In another variation of this embodiment, the sheet bar is heated for about 25 minutes.

The cooling in step (b) can be performed at ambient atmosphere, by increasing argon pressure, or by water cooling. In a preferred embodiment, the cooling in step (b) is performed by fan air cooling or faster. Depending on the sheet bar gage, water quench may be used for thick sheet bar (generally above about 0.5" thick). Fan cool may be sufficient for thinner sheet bar (generally less than about 0.5" thick). If cooling rate is too slow, structure with thick alpha laths will be formed after cooling, which will prevent material from developing fine grains during intermediate and finishing rolling.

Step C—Intermediate Hot Rolling

In a preferred embodiment, the heating of the sheet bar in step (c) is performed at a temperature between about 1400° F. (760° C.) to about 1550° F. (843° C.). In a variation of this embodiment, the heating step is performed at a temperature between about 1450° F. (788° C.) to about 1500° F. (816° C.). In a specific embodiment, the heating step is performed at a temperature at about 1475° F. (802° C.).

If the heating temperature is too high, grain coarsening can occur resulting in coarse grain structure even after hot rolling. If the heating temperature is too low, flow stress of material increases resulting overload of rolling mill. Hot rolling is preferably performed with a cascade rolling method without reheat after each pass. Steel pack can be, but does not have to be, used for this intermediate hot rolling. However, reheat can be done, if necessary.

In a preferred embodiment, the sheet bar in step (c) is heated for about 30 minutes to about 1 hour. In variations of this embodiment, the sheet bar is heated for about 40 minutes to about 50 minutes. In another variation of this embodiment, the sheet bar is heated for about 45 minutes.

In a preferred embodiment, the intermediate gage (formed in step c) has a thickness from about 0.10" (0.3 cm) to about 0.60" (1.5 cm). In variations of this embodiment, the intermediate gage has a thickness of about 0.10", about 0.20", about 0.30", about 0.40", about 0.50", about 0.60" or any increment in between. The thickness of the intermediate gage is typically chosen based on the thickness of the desired final gage.

The reduction in step (c) is defined as (Ho−Hf)/Ho*100, wherein Ho is the gage of input plate and Hf is a gage of finished gage. In a preferred embodiment, the hot rolling of step (c) has a total reduction controlled between about 40% to about 80%. In variations of this embodiment, the hot rolling step (c) has a total reduction controlled between about 60% to about 70%. In other variations of this embodiment, the hot rolling step (c) has a total reduction controlled at about 40%, 45%, 50%, about 55%, about 60%, about 65%, about 70%, about 75%, or about 80%.

Following the heating and rolling in step (c), the intermediate gage can proceed directly to the finishing hot rolling step (step d) or it can be cooled by a number of methods prior to proceeding. For example, the intermediate gage can be cooled using ambient atmosphere, by increasing argon pressure, or by water cooling. In a preferred embodiment, the cooling is performed by ambient atmosphere.

Step D—Finishing Hot Rolling

In a preferred embodiment, the heating of the intermediate gage in step (d) is performed at a temperature between about 1400° F. (760° C.) to about 1550° F. (843° C.). In a variation of this embodiment, the heating step is performed at a temperature between about 1450° F. (788° C.) to about 1500° F. (816° C.). In a specific embodiment, the heating step is performed at a temperature at about 1475° F. (802° C.).

If the heating temperature is too high, grain coarsening takes place resulting coarse grain structure. If the heating temperature is too low, flow stress of materials increases resulting overload of rolling mill. Final hot rolling should be performed with a cascade rolling method without reheat after each pass. In a preferred embodiment, the hot rolling of step (d) is performed with a rolling direction perpendicular to the rolling direction of step (c). In a preferred embodiment, the hot rolling of step (d) utilizes a steel pack in order to avoid excessive heat loss during rolling.

In a preferred embodiment, the intermediate gage in step (d) is heated for about 30 minutes to about 3 hours. In variations of this embodiment, the sheet bar is heated for about 1 hour to about 2 hours. In another variation of this embodiment, the sheet bar is heated for about 1 hour and 30 minutes.

In a preferred embodiment, the final gage (formed in step d) has a thickness from about 0.01" (0.025 cm) to about 0.20" (0.51 cm). In variations of this embodiment, the final gage has a thickness of about 0.025" to about 0.15". In other variations of this embodiment, the final gage has a thickness of about 0.05" to about 0.1". In still other variations of this embodiment, the final gage has a thickness of about 0.010", about 0.020", about 0.030", about 0.040", about 0.050", about 0.060", about 0.070", about 0.080", about 0.090", about 0.100", about 0.110", about 0.120", about 0.130", about 0.140", about 0.150", about 0.160", about 0.170", about 0.180", about 0.190", about 0.200", or any increment in between. The thickness of the final desired gage is typically chosen according to the ultimate application of the alloy.

The reduction in step (d) is defined as (Ho−Hf)/Ho*100, wherein Ho is the gage of input plate and Hf is a gage of finished gage. In a preferred embodiment, the hot rolling step of (d) has a total reduction controlled between about 40% to about 75%. In variations of this embodiment, the hot rolling step (d) has a total reduction controlled between about 50% to about 60%. In other variations of this embodiment, the hot rolling step (c) has a total reduction controlled at about 45%, about 50%, about 55%, about 60%, about 65%, about 70%, or about 75%.

Following the heating and rolling in step (d), the final gage can proceed directly to the annealing step (step e) or it can be cooled by a number of methods prior to proceeding. For example, the final gage can be cooled using ambient atmosphere, by increasing argon pressure, or by water cooling. In a preferred embodiment, the cooling is performed by ambient atmosphere.

Step E—Annealing

In a preferred embodiment, the heating of the final gage in step (e) is performed at a temperature between about 1300° F. (704° C.) to about 1550° F. (843° C.). In a variation of this embodiment, the heating step is performed at a temperature between about 1350° F. (732° C.) to about 1500° F. (816° C.). In another variation of this embodiment, the heating step is performed at a temperature between about 1400° F. (760° C.) to about 1450° F. (788° C.). In yet another variation of this embodiment, the heating step is performed at a temperature between about 1300° F. (704° C.) to about 1400° F. (760° C.). In a specific embodiment, the heating step is performed at a temperature at about 1425° F. (774° C.).

If annealing temperature is too low, stress from hot rolling will not be relieved and rolled microstructure will not fully be recovered.

In a preferred embodiment, the heating of the final gage in step (e) is heated for about 30 minutes to about 1 hour. In a variation of this embodiment, the sheet bar is heated for about 40 minutes to about 50 minutes. In another variation of this embodiment, the sheet bar is heated for about 45 minutes.

The cooling in step (e) can be performed at ambient atmosphere, by increasing argon pressure, or by water cooling. In a preferred embodiment, the cooling in step (e) is performed by ambient atmosphere.

Step F

The grinding of the annealed gage in step (f) is performed by any suitable grinder. In a preferred embodiment, the grinding is performed by a sheet grinder.

In a preferred embodiment, the annealed gage in step (f) is pickled to remove oxides and alpha case formed during thermo-mechanical processing after the grinding step.

In a preferred embodiment, the titanium alloy is Ti-54M, which has been previously described in U.S. Pat. No. 6,786,985 by Kosaka et al. entitled "Alpha-Beta Ti—Al—V—Mo—Fe Alloy", which is incorporated herein in its entirety as if fully set forth in this specification.

Example 1

Superplastic forming (SPF) properties of Ti-54M (Ti-5Al-4V-0.6Mo-0.4Fe) sheet were investigated. A total elongation of Ti-54M exceeded 500% at temperatures between 750° C. and 850° C. at a strain rate of $10^{-3}$/S. Values of strain rate sensitivity (m-value) measured by jump strain rate tests were 0.45 to about 0.6 in a temperature range of 730° C. to 900° C. at a strain rate of $5\times10^{-4}$/S or $1\times10^{-4}$/S. Flow stress of the alloy was 20% to about 40% lower than that of Ti-6Al-4V(Ti-64) mill annealed sheet. The observed microstructure after the tests revealed the indication of grain boundary sliding in a wide range of temperatures and strain rates.

Materials

A piece of Ti-54M production slab was used for the experiment. Two Ti-54M sheets 0.375" (0.95 cm) were produced using different thermo-mechanical processing procedures, denoted by Process A and Process B, in a laboratory facility. A Ti-64 production sheet sample 0.375" (0.95 cm) was evaluated for comparison. Chemical compositions of the materials are shown in Table 1. As can be seen, Ti-54M contained a higher concentration of beta stabilizer with a lower Al content compared to Ti-64. Room temperature tensile properties of a typical Ti-54M sheet are shown in Table 2.

TABLE 1

Chemical compositions of the sheets used for SPF evaluation. [wt %]

| Alloy | Al | V | Mo | Fe | C | O | N |
|---|---|---|---|---|---|---|---|
| Ti-54M | 4.94 | 3.83 | 0.55 | 0.45 | 0.018 | 0.15 | 0.007 |
| Ti-64 | 6.19 | 3.96 | 0.01 | 0.17 | 0.016 | 0.17 | 0.007 |

TABLE 2

Room temperature mechanical properties of a typical Ti-54M sheet.

| UTS, MPa (ksi) | 0.2% PS, MPa (ksi) | % El | % RA | Modulus, GPA (msi) |
|---|---|---|---|---|
| 940 (136) | 870 (126) | 16.5 | 50.3 | 114 (16.5) |

Throughout this example "Process A" and "Process B" signify the method performed according to the standard/known process. The processing history for the production of Ti-54M sheets in this example is set forth in Table 1.

TABLE 3

| Item | Operation | Process A | Process B |
|---|---|---|---|
| Manufacturing Process | Sheet bar thickness, in | 0.375 | 0.375 |
| | Beta Quench | 1920 F./20 min/WQ | 1920 F./20 min/WQ |
| | Rolling temp, F. | 1700 | 1650 |
| | Intermediate gage, in | 0.170 | 0.170 |
| | Reduction, % | 54.7 | 54.7 |
| | Steel pack | Yes | Yes |
| | Cross rolling temp, F. | 1700 | 1650 |
| | Final gage, in | 0.080 | 0.115 |
| | Reduction, % | 52.9 | 32.4 |
| | Final gage anneal temperature, F. | 1400 | 1600 |

Figure 3B:
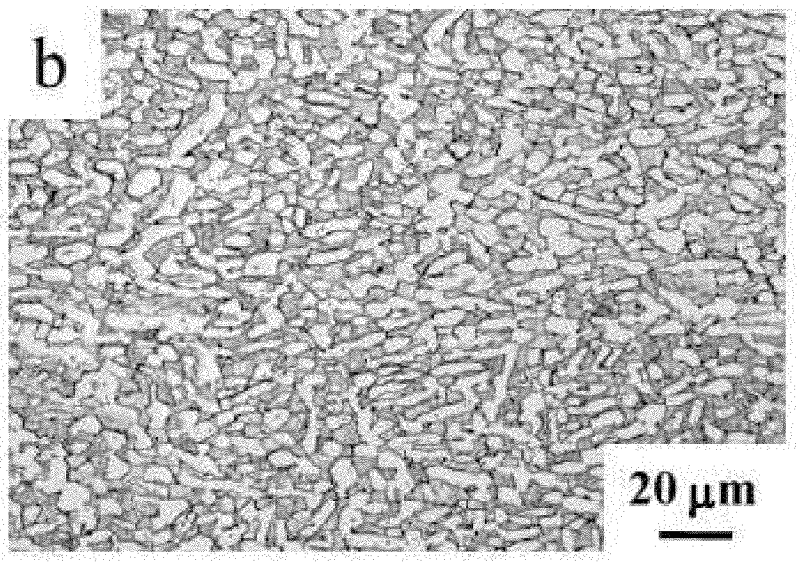
FIG. 3B. Photograph showing the microstructure of a titanium alloy, prior to SPF tests, processed according to Process B as described herein.
Figure 3A:
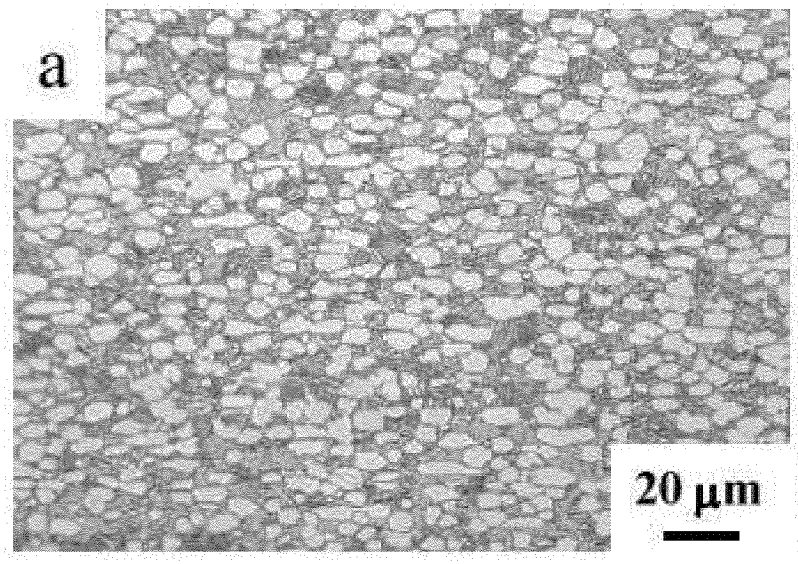
FIG. 3A. Photograph showing the microstructure of a titanium alloy, prior to SPF tests, processed according to Process A as described herein.

FIG. 3 shows the initial microstructures of the Ti-54M sheets produced by the two processes described in Table 3. Volume Fraction Alpha (VFA) estimated according to ASTM E562 indicated 42% primary alpha (equiaxed) and average grain size measured according to ASTM E112 was 11 μM for the sheet produced by Process A (FIG. 3A). For the sheet produced by Process B, VFA was estimated to be 45% and average primary alpha grain size (slightly elongated) was measured as 7 μm. The microstructures in FIG. 3 and grain size are considered to be typical produced by conventional process. It should be noted that Process A material contained numerous secondary alpha laths in transformed beta phase, however, Process B material contained few secondary alpha laths.

SPF Evaluations

Two kinds of tests were conducted to evaluate SPF capability of the sheet materials. Elevated temperature tensile tests were performed at a strain rate of $1\times10^{-3}$/S until failure with sheet specimens with a gage length of 7.6-mm. Strain rate sensitivity tests to measure m-values were performed in accordance with ASTM E2448-06. Strain rates of the tests were $5\times10^{-4}$/S and $1\times10^{-4}$/S at temperatures between 732° C. and 899° C. Microstructures of the cross-section of the reduced section were observed after the tests.

Results of the Elevated Temperature Tensile Test

Figure 4:
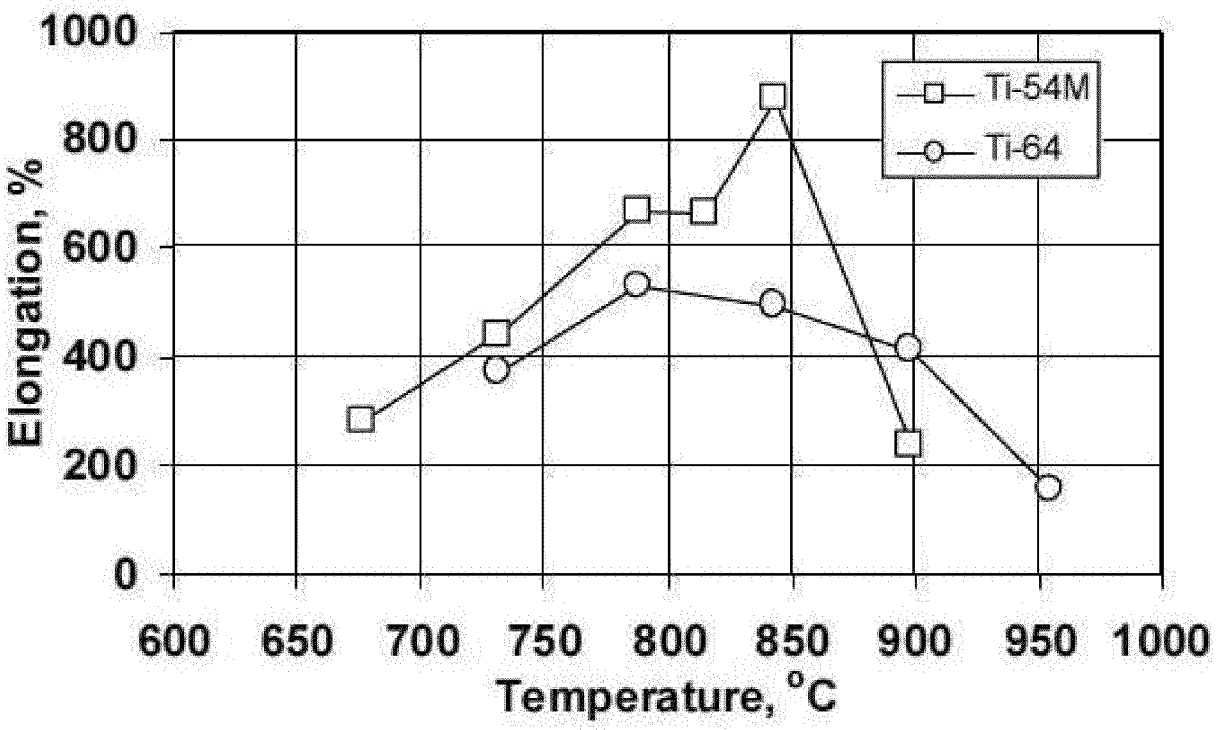
FIG. 4. Graph illustrating elongation with test temperature in Ti-54M Process A sheet and Ti-64 sheet.

Uniaxial tension tests were conducted at a strain rate of $1\times10^{-3}$/S in an Argon gas environment at temperatures from 677° C. to 899° C. FIG. 4 compares a total elongation of Ti-54M with that of Ti 64. As can be seen, Ti-54M sheet showed larger elongation than Ti-64 in a temperature range of 760° C. to 870° C.

Figure 5B:
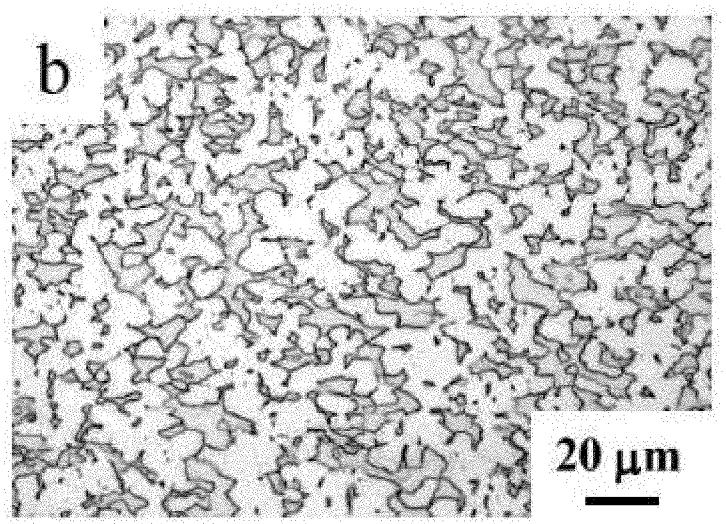
FIG. 5B. Longitudinal microstructure of a reduced section of SPF coupon sample tested at 1450° F. (788° C.).
Figure 5A:
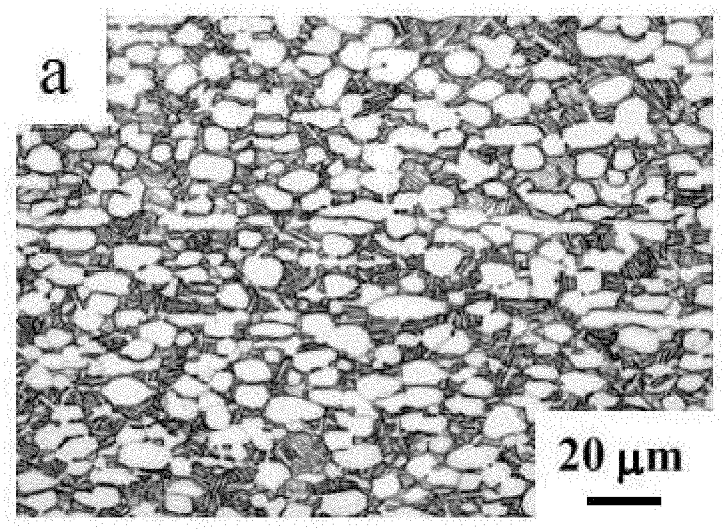
FIG. 5A. Longitudinal microstructure of a grip area of SPF coupon sample tested at 1450° F. (788° C.).

FIG. 5 shows the microstructure of the grip area and the reduced section of the specimen tested at 788° C. A significant difference from the original structure (FIG. 3A) was observed in the reduced section, which was influenced by a heavy plastic deformation. The microstructure of the reduced section revealed the characteristics of grain boundary sliding showing curved grain boundaries and the movement of original primary alpha grains.

Results of Flow Stress Measurements.

Figure 6:
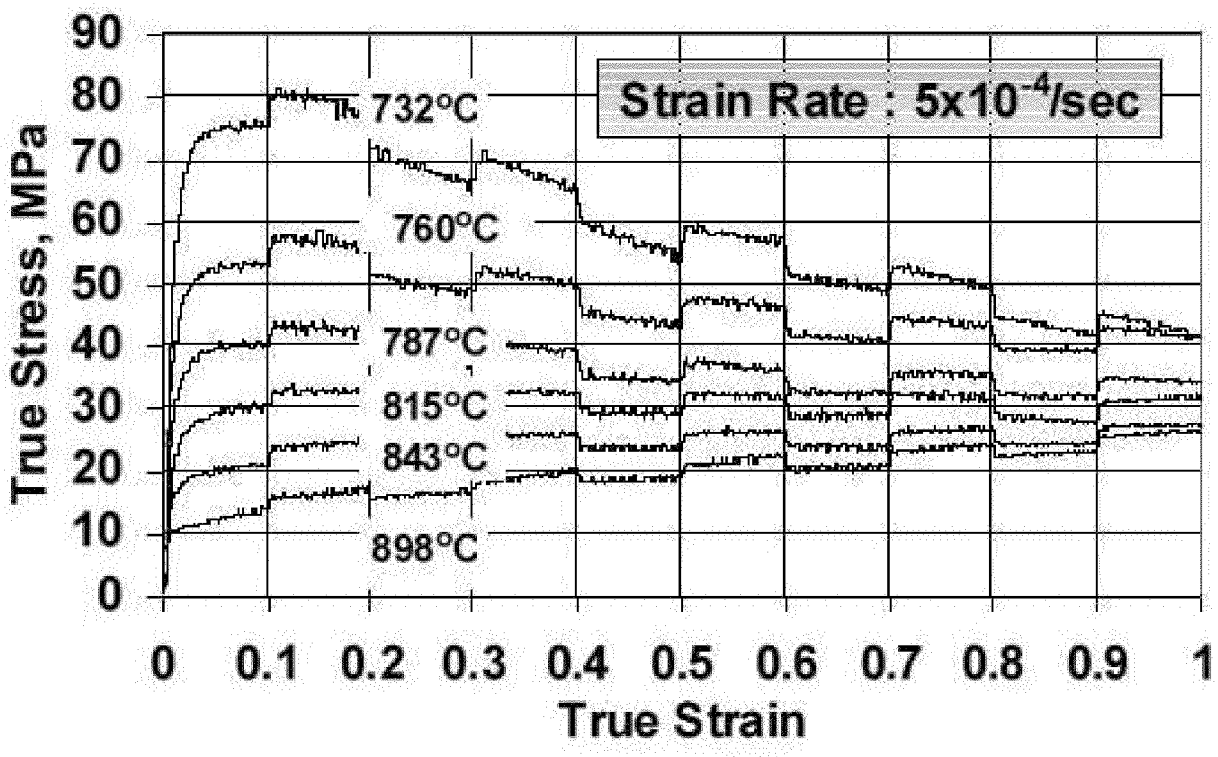
FIG. 6. Graph showing true stress-true strain curves obtained by jump strain rate tests of Ti-54M (Process A) at $5\times10^{-4}$/S.

True stress-true strain curves obtained by jump strain rate tests for Ti-54M Process A material at a strain rate of $5\times10^{-4}$/S are shown in FIG. 6. A large variation of the stress-strain curve was seen depending on test temperature.

Figure 7B:
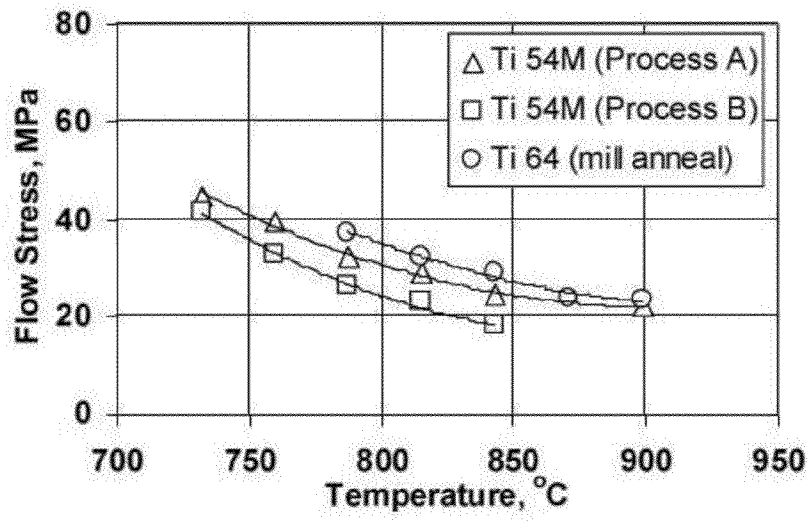
FIG. 7B. Comparison of flow stress obtained by SPF tests on three sheets at a true strain of 0.8 at a stain rate of $5\times10^{-4}$/S.
Figure 7A:
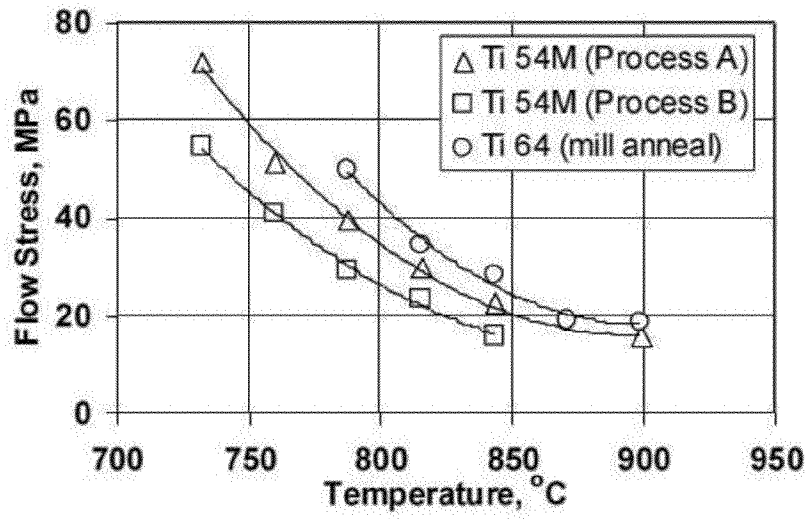
FIG. 7A. Comparison of flow stress obtained by SPF tests on three sheets at a true strain of 0.2 at a stain rate of $5\times10^{-4}$/S.

FIG. 7 shows the comparison of flow stress at a constant true strain of 0.2 and 0.8 for a strain rate of $5\times10^{-4}$/S. The flow stress of Ti-54M was typically about 20% to about 40% lower than that of Ti-64. Ti-54M produced by Process B showed the lowest flow stress at any test conditions.

Measurement of Strain Rate Sensitivity (m-value)

Figure 8B:
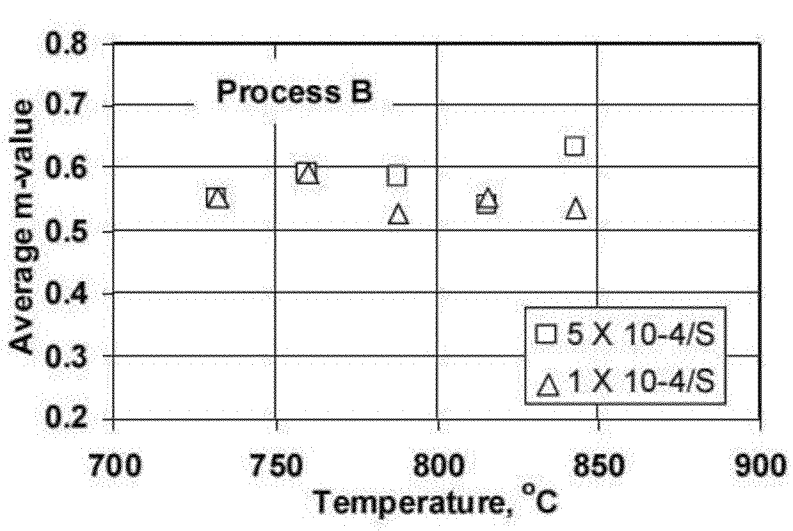
FIG. 8B. Average m-value obtained by SPF tests on Ti-54M sheets using Process B at strain rates of $5\times10^{-4}$/S and $1\times10^{-4}$/S.
Figure 8A:
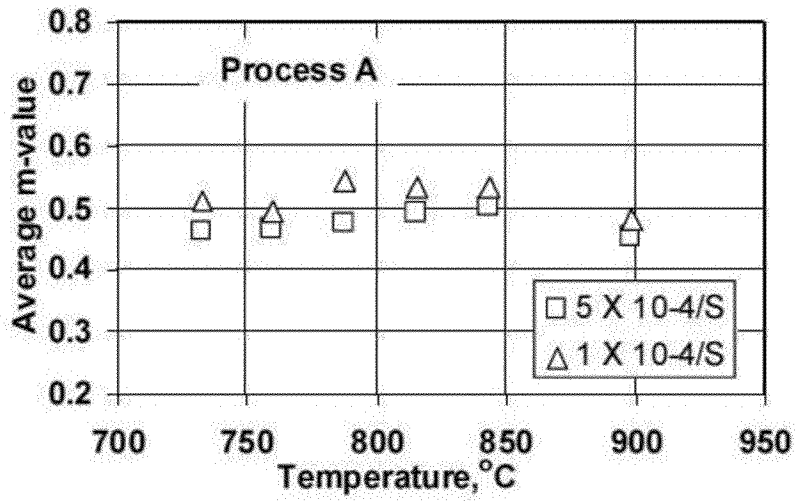
FIG. 8A. Average m-value obtained by SPF tests on Ti-54M sheets using Process A at strain rates of $5\times10^{-4}$/S and $1\times10^{-4}$/S.
Figure 9A:
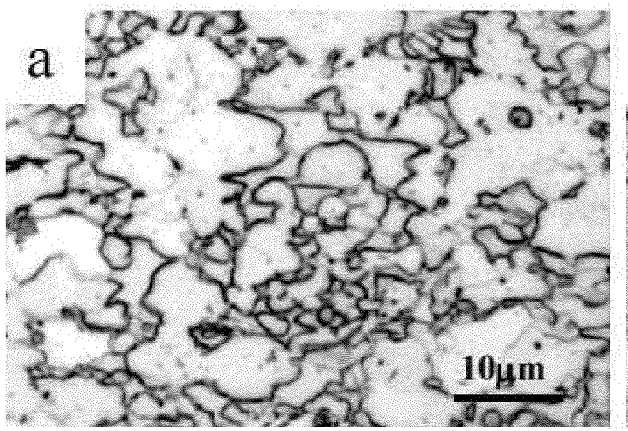
FIG. 9A. Microstructure of reduced section after jump strain rate test using Process A, tested at 1350° F. (732° C.) and a strain rate of $5\times10^{-4}$/S. (Load axis towards horizontal direction)
Figure 9B:
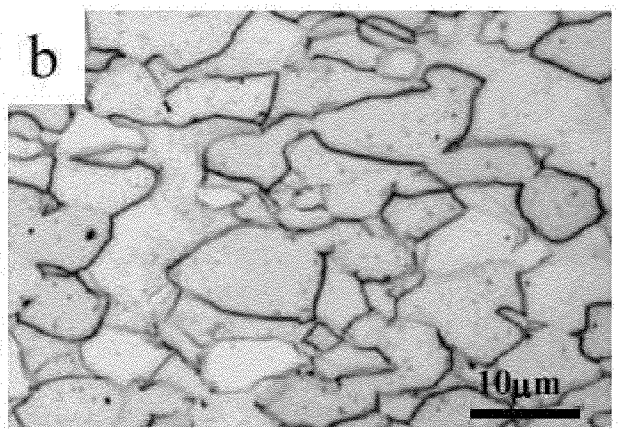
FIG. 9B. Microstructure of reduced section after jump strain rate test using Process A, tested at 1550° F. (843° C.) and a strain rate of $5\times10^{-4}$/S. (Load axis towards horizontal direction)
Figure 9C:
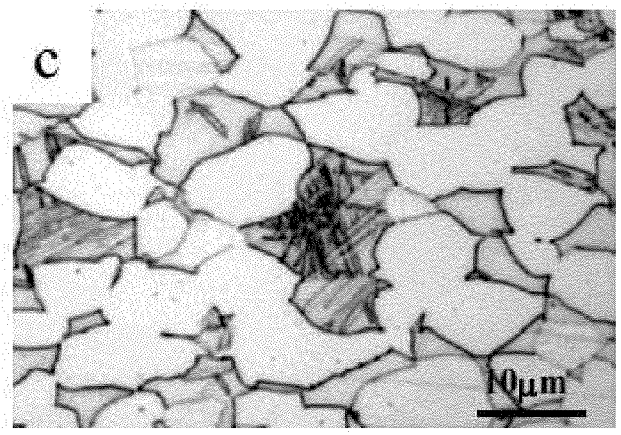
FIG. 9C. Microstructure of reduced section after jump strain rate test using Process B, tested at 1550° F. (843° C.) and a strain rate of $1\times10^{-4}$/S. (Load axis towards horizontal direction)
Figure 9D:
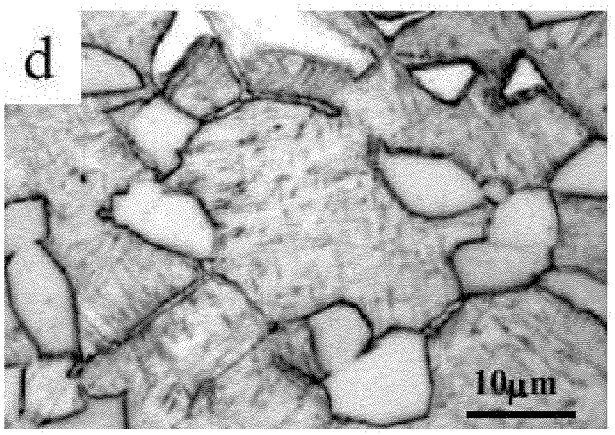
FIG. 9D. Microstructure of reduced section after jump strain rate test using Process B, tested at 1650° F. (899° C.) and a strain rate of $1\times10^{-4}$/S. (Load axis towards horizontal direction)

FIG. 8 shows the average m-value obtained at four different true strains in Ti-54M sheets. The average m-value of Ti-54M Process A sheet was greater than 0.45 and that of Process B was greater than 0.50, regardless of test temperature and strain rate. The highest m-value was seen at temperatures between 780° C. and 850° C. for Process A material, where the m-values at $1\times10^{-4}$/sec was slightly higher than those at $5\times10^{-4}$/sec.

Micro-Structural Development

The true stress-true strain curves obtained by the jump strain rate tests showed three types of flow curves due to the difference of dynamic restoration process. Flow softening was observed in the tests at lower temperature or higher strain rate. Steady flow curves were obtained in the tests at intermediate temperatures. Flow hardening or strain hardening was seen in the tests at higher temperature with slower strain rate. Microstructures of the reduced section after the test were observed on the tested specimens.

FIG. 9 shows the microstructures of selected test samples having a different type of flow curves. Extremely fine alpha grains were frequently observed at prior transformed beta grains (FIG. 9A). This is considered to be due to a dynamic globularization of secondary alpha lath structure in the transformed beta of Process A material. Part of the applied stress was believed to be consumed for the globularization at an early stage of deformation[12]. The most common microstructure observed in the samples that have exhibited steady flow curves is given in FIG. 9B, where primary grain boundaries are relatively curved showing an indication of the occurrence of grain boundary sliding. FIGS. 9C and 9D were taken from the samples that exhibited flow hardening. Both samples were tested at higher temperatures with slower strain rate. Since grain coarsening may become an obstacle to grain boundary sliding, the grains are coarser and a morphology of primary alpha grains is more angular in nature. It was not evident whether the coarser grains resulted from dynamic coarsening[20]. It should be noted that prior beta grains had an indication of transformed products that formed during cooling, suggesting leaner beta stabilizer causing a decomposition of beta phase, although a further analysis was not conducted.

Flow Stress Analysis

The present work revealed that the flow stress of Ti-54M was significantly lower than that of Ti-64. A primary contributor of lower flow stress is considered to be the effect of Fe that accelerates diffusion leading to lower flow stress, which is evident from the equation for strain rate given by Mukherjee et. al.[23]. In addition, lower Al content is another contributor to lower flow stress as Al strengthens both alpha and beta phases at elevated temperatures.

Figure 10B:
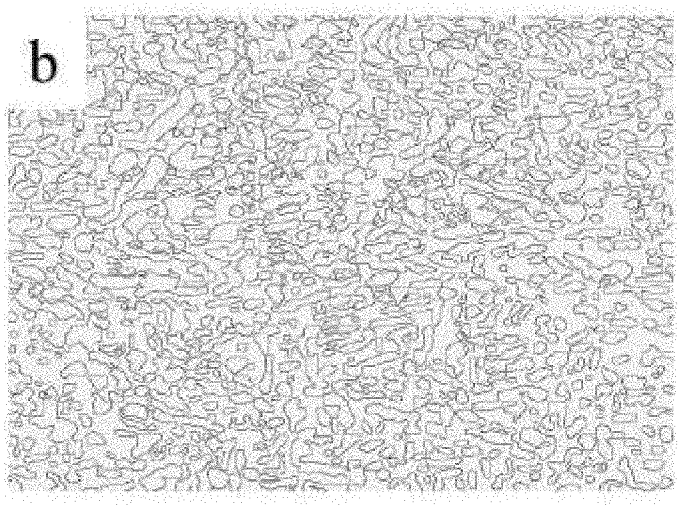
FIG. 10B. Image of grain boundary of primary alpha phase of as received microstructure in FIG. 2B analyzed with Fovea Pro. Grain Boundary Density, Process B (0.53 μm/μm$^2$)
Figure 10A:
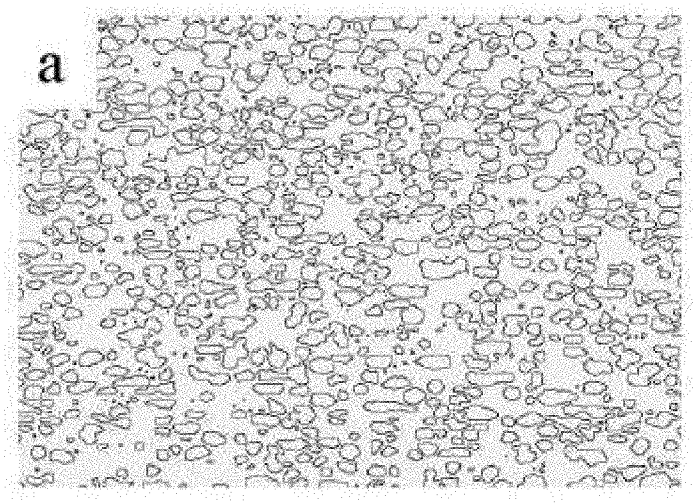
FIG. 10A. Image of grain boundary of primary alpha phase of as received microstructure in FIG. 3A analyzed with Fovea Pro. Grain Boundary Density, Process A (0.25 $\mu m/\mu m^2$).
Figure 11:
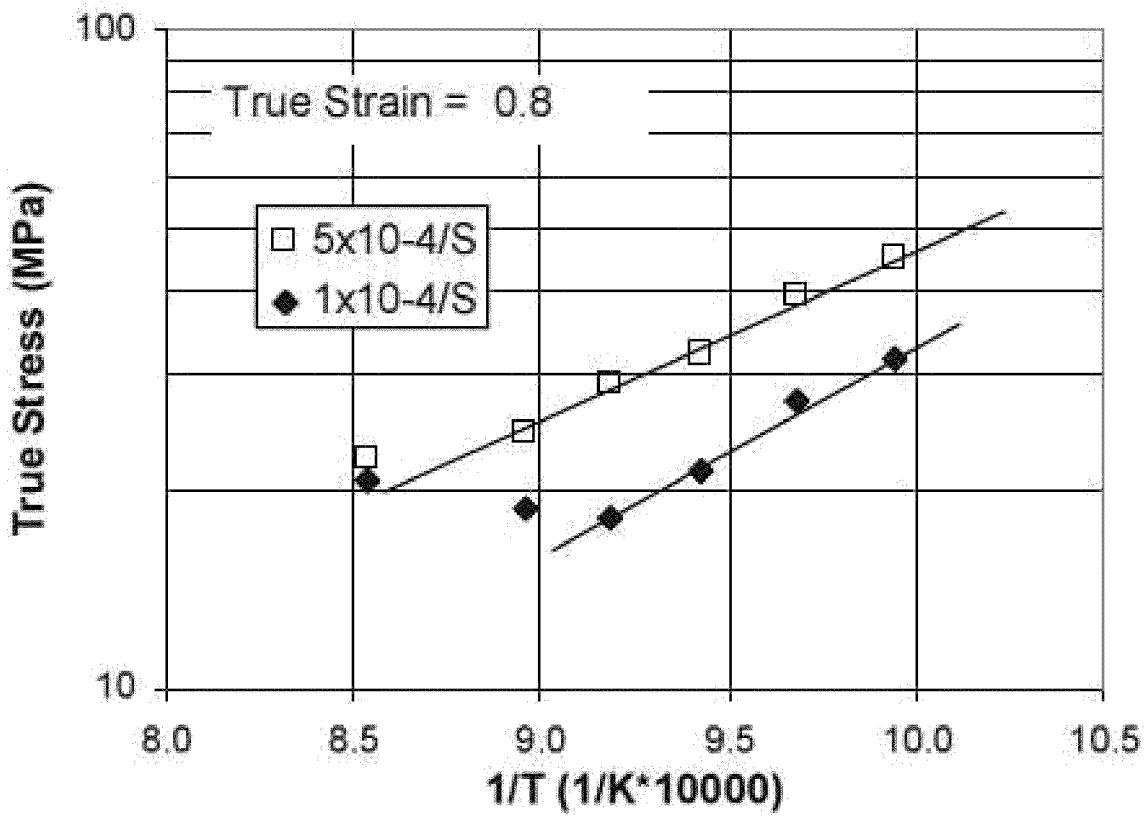
FIG. 11. Relationship between flow stress at true strain of 0.8 and inverse temperature 1/T tested at $5\times10^{-4}$/S and $1\times10^{-4}$/S.

The present results indicated that there was a significant difference in the flow stress between Process A and Process B materials. It is commonly understood that grain size is one of the most influential factors on superplastic formability, which is also shown in the aforementioned equation. The characterization of Ti-54M materials revealed that Process B sheet has slightly smaller primary alpha grains, however, the volume fraction of primary alpha phase in these two materials was very close. An attempt was made to quantify grain boundary length of microstructures shown in FIG. 3 using FOVEA PRO (Reindeer Graphics). The images captured by the analysis are given in FIG. 10. The result indicates that Process B material has a two-times higher grain boundary length per unit area than Process A material. In other words, Process B materials contained a greater amount of alpha grain boundary area that could contribute to grain boundary sliding with lower flow stress[24]. The absence of secondary alpha laths in Process B material might have contributed to the lower flow stress as well. FIG. 11 shows a plot of flow stress vs inverse temperature (1/T) at a strain of 0.8 in Process A material. The flow stress tested at $5\times10^{-4}$/S and 1/T showed a linear relationship suggesting the deformation is controlled by the same mechanism; i.e. possibly by grain boundary sliding. On the other hand, a deviation from a linear relationship was observed at a higher temperature range when tested at $1\times10^{-4}$/S (see FIG. 11). This result suggests that grain boundary sliding is no longer a predominant deformation mechanism at this condition, which is in agreement with the observation of coarse angular grains.

Summary

Ti-54M exhibited superplastic forming capability at a temperature range between 730° C. to 900° C. Values of strain rate sensitivity were measured between 0.45 to 0.60 at a strain rate of $5\times10^{-4}$/S and $1\times10^{-4}$/S. Flow stress of the alloy was approximately 20% to about 40% lower than that of Ti-64 mill annealed sheet. The morphology of alpha phase and grain boundary density as well as constituents of transformed beta phase had a significant influence on the flow stress levels and the flow curves of superplastic forming in Ti-54M.

Example 2

Ti-54M exhibits superior machinability in most machining conditions and strength comparable to that of Ti-64. The flow stress of the alloy is typically about 20% to about 40% lower than that of mill-annealed Ti-64 under similar test conditions, which is believed to be one of the contributors to its superior machinability. SPF properties of this alloy were investigated and a total elongation exceeding 500% was observed at temperatures between 750° C. and 850° C. at a strain rate of $10^{-3}$/S. A steady flow behavior, which indicates the occurrence of superplasticity, was observed at a temperature as low as 790° C. at a strain rate of $5\times10^{-4}$/S. It is well understood that grain size is one of the critical factors that influences superplasticity. Fine grain Ti-54M sheets with about 2 to about 3 μm grain size, produced in a laboratory facility, demonstrated that SPF would be possible at temperatures as low as 700° C. The following results report superplastic behavior of fine grain Ti-54M compared with Ti-64 and discuss metallurgical factors that control low temperature superplasticity.

Ti-54M Sheet Materials

A piece of Ti-54M production slab was used for making sheets in the laboratory. The chemical composition of the material was the same as in Example 1: Ti-4.94% Al-3.83% V-0.55% Mo-0.45% Fe-0.15% O (β transus: 950° C.). Ti-54M sheets with a gage of 0.375" (0.95 cm) were produced using two different thermo-mechanical processing routes to obtain different microstructures.

Throughout this example, standard grain (SG) signifies that the Ti-54M sheets were process according the standard/known process as discussed in Example 1, Process A. Fine grain (FG) signifies that the Ti-54M sheets were processed according to the embodiments of the present disclosure. Specifically, Fine Grain (FG) sheets were produced with the thermo-mechanical processing routes as shown in Table 4.

TABLE 4

Processing history for the production of Ti-54M sheets.

| Item | Operation | Standard Grain (SG) | Fine Grain (FG) |
|---|---|---|---|
| Manufacturing Process | Sheet bar thickness, in | 0.375 | 0.75 |
| | Beta Quench | 1920 F./ 20 min/WQ | 1920 F./ 20 min/WQ |
| | Rolling temp, F. | 1700 | 1325 |
| | Intermediate gage, in | 0.170 | 0.173 |
| | Reduction, % | 54.7 | 76.9 |
| | Steel pack | Yes | Yes |
| | Cross rolling temp, F. | 1700 | 1325 |
| | Final gage, in | 0.080 | 0.080 |
| | Reduction, % | 52.9 | 53.8 |
| | Final gage anneal temperature, F. | 1400 | 1350 |

Figure 12B:
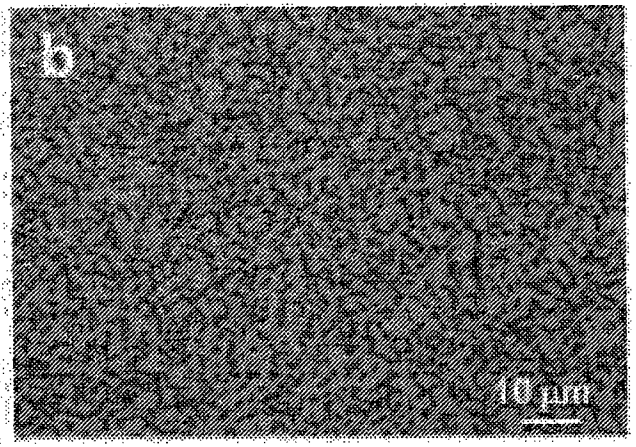
FIG. 12B. Microstructure of fine grain Ti-54M sheets.
Figure 12A:
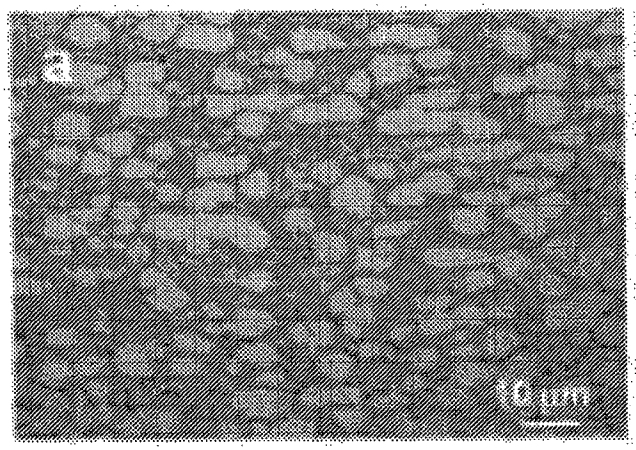
FIGURE 12A (PRIOR ART)
FIG. 12A. Microstructure of standard grain Ti-54M sheets.

FIG. 12 shows the microstructures of two materials in the longitudinal direction. The average grain size of standard grain (SG) sheet was approximately 11 μm and that of fine grain (FG) sheet was approximately 2 to about 3 μm, respectively. Fine grain was produced in a laboratory mill; however, the rolling temperature was too low to be applied to production mill as described in Example 1, FIG. 3. Results of tensile tests of as received sheets at room temperature are given in Table 5.

TABLE 5

Tensile properties of Ti-54M sheet materials

| | Dir | 0.2% PS (MPa) | UTS (MPa) | El (%) |
|---|---|---|---|---|
| Ti-54M | L | 845 | 926 | 10 |
| SG | T | 879 | 944 | 11 |
| Ti-54M | L | 887 | 903 | 17 |
| FG | T | 876 | 903 | 18 |

Evaluation of Superplasticity and Flow Behavior

Two kinds of tests were conducted to evaluate SPF capability of the sheet materials. Elevated temperature tensile tests were performed at a strain rate of $1\times10^{-3}$/S until failure with sheet specimens of gage length was 7.6-mm. Strain rate sensitivity tests to measure m-values were performed in accordance with ASTM E2448-06. Strain rates of the tests were selected between $1\times10^{-4}$/S and $1\times10^{-3}$/S at temperatures between 1250° F. (677° C.) and 1650° F. (899° C.) in argon gas. Microstructures of the cross-section of the reduced section were assessed after the tests.

Superplastic Properties of Ti-54M

Elevated Temperature Tensile Behavior

Figure 13:
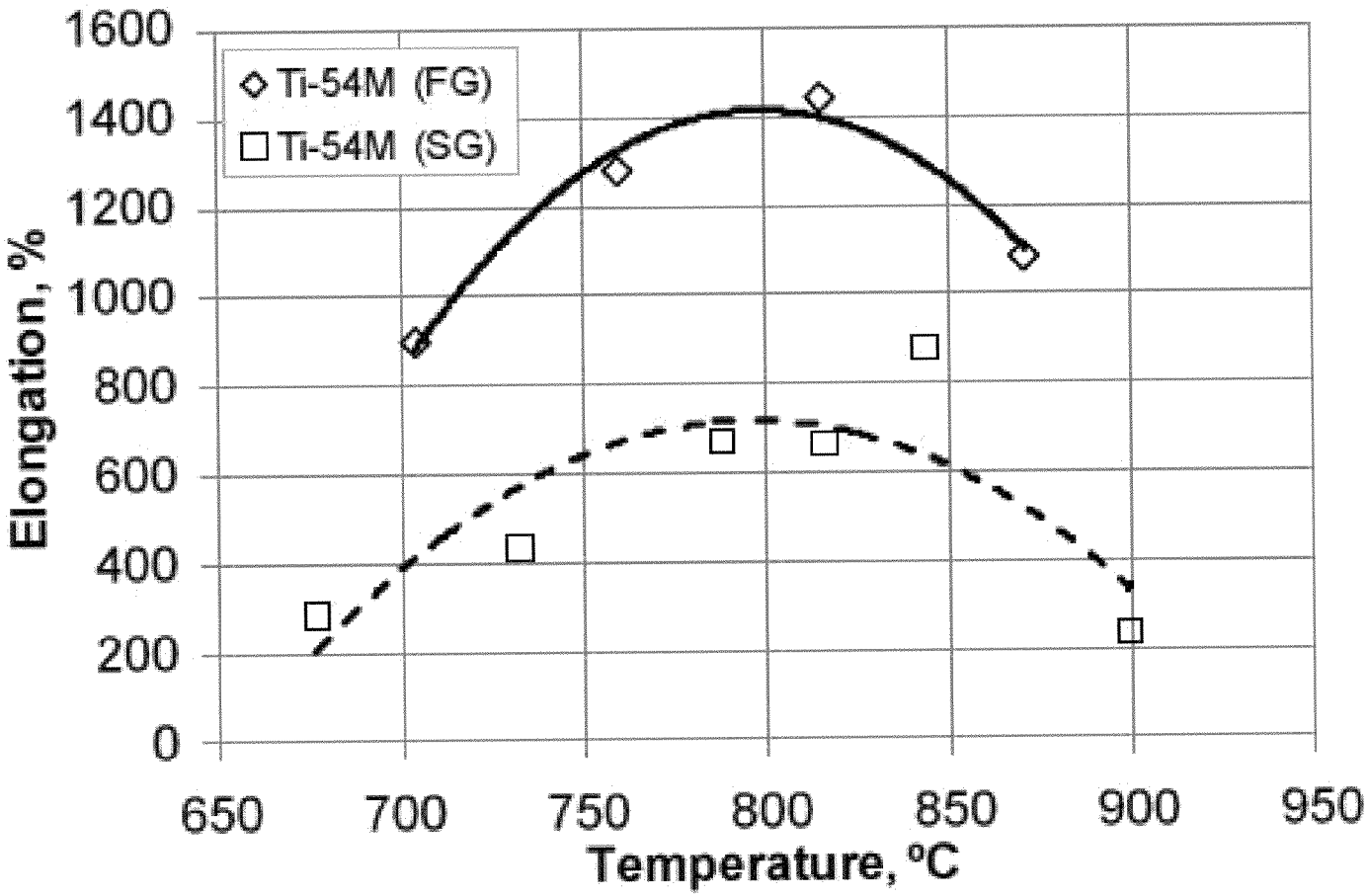
FIG. 13. Comparison of total elongation at elevated temperatures between Ti-54M (SG) and (FG).

FIG. 13 compares elongation of Ti-54M (SG) and Ti-54M (FG) tested at $1\times10^{-3}$/S of strain rate. Both SG and FG Ti-54M sheets showed the maximum elongation at about 1436° F. (780° C.) to about 1508° F. (820° C.). It is evident from the figure that Ti-54M (FG) showed higher elongation compared with Ti-54M (SG), which itself showed elongation higher than 500% over a wide range of temperatures. The high elongation is an indication of excellent superplasticity.

Figures 14A, 14B:
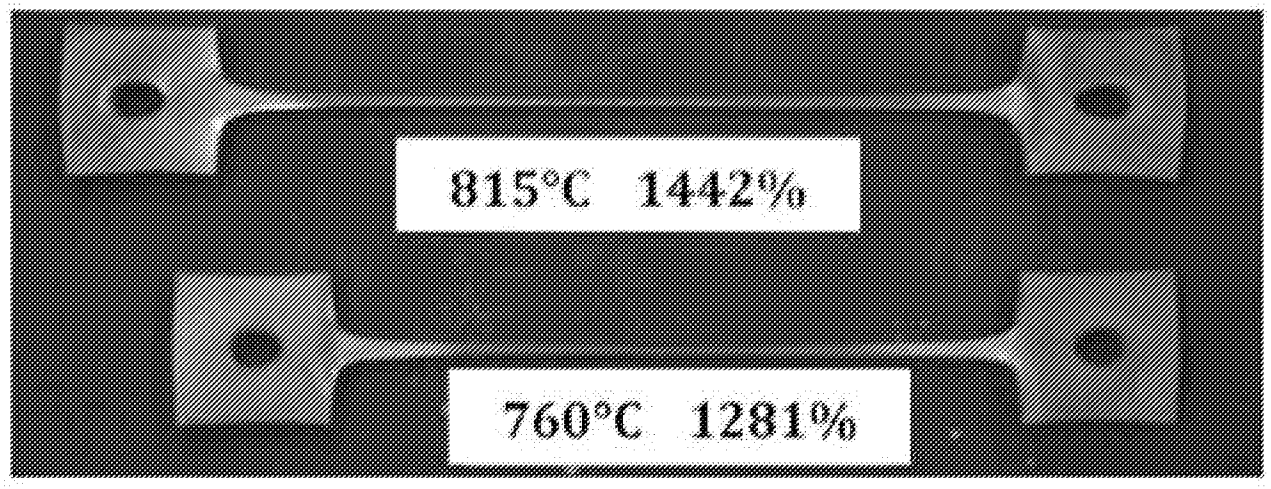
FIG. 14A. Appearance of tensile test specimens of Ti-54M (FG) tested at 1500° F. (815° C.).
FIG. 14B. Appearance of tensile test specimens of Ti-54M (FG) tested at 1400° F. (760° C.).

FIG. 14 shows the appearance of the tensile specimens of Ti-54M (FG) tested at 1500° F. (815° C.) and 1400° F. (760° C.), respectively. A total elongation exceeded 1400% at 1500° F. (815° C.), indicating excellent SPF capability, although elongation higher than 1000% may not usually be required in practice.

Flow Curve and Strain Rate Sensitivity (m-value)

Figure 15A:
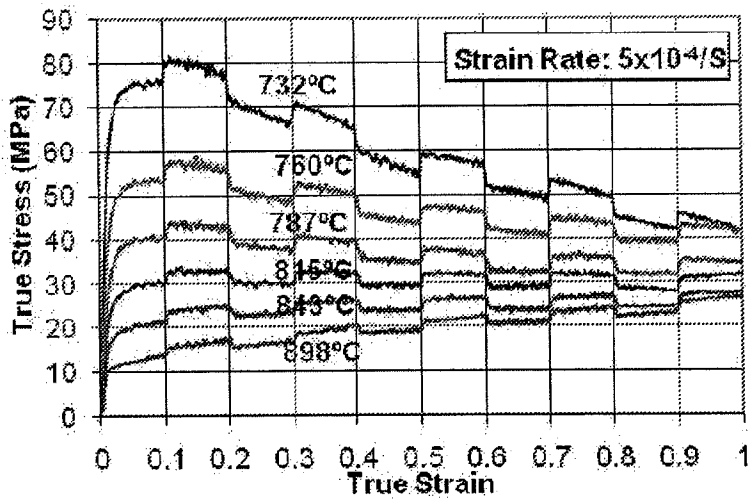
FIGURE 15A (PRIOR ART)
FIG. 15A. Flow Curves of standard grain Ti-54M obtained by strain rate jump tests.
Figure 15B:
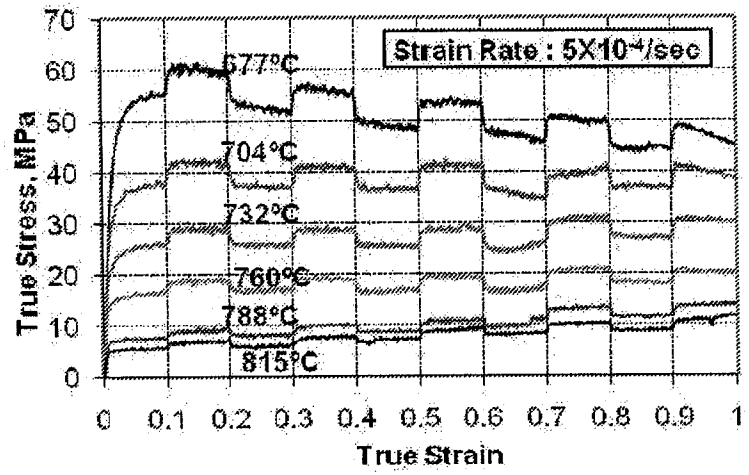
FIG. 15B. Flow Curves of fine grain Ti-54M obtained by strain rate jump tests.

Flow stress and strain rate sensitivity (m-value) were measured on Ti-54M (FG) and Ti-54M (SG) at various test conditions. Flow curves tested at $5\times10^{-4}$/S are shown in FIG. 15. As can be seen in the figure, a 20% stress jump was applied every 0.1 of true strain to measure m-value. In both materials, flow curve changes were observed from showing an increase in flow stress with strain (work hardening), through a stable flow stress with strain, to flow softening behavior with increase in test temperature. These results indicated changes in plastic flow mechanism.

Ti-54M (SG) material exhibited stable flow behavior at 787° C. and 815° C., where grain boundary sliding is considered to be a predominant mechanism of plastic deformation. In practical superplastic forming operations, the best results are expected at this temperature range. A similar flow behavior was obtained by Ti-54M (FG) material, however, the temperature range that showed a flatter flow curve was observed between 704° C. and about 760° C., and the flow behavior was stable over a wider temperature range.

Figure 16:
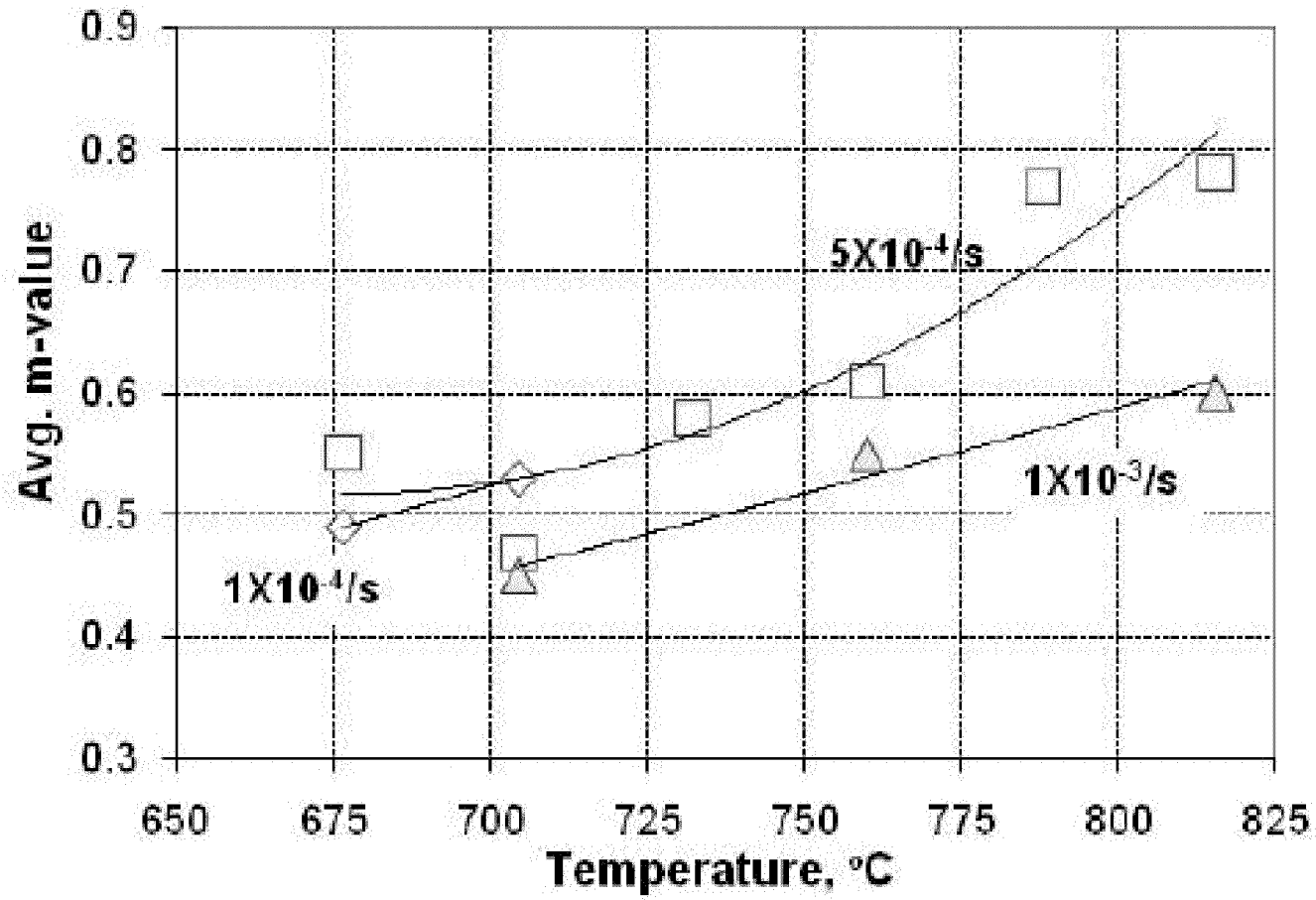
FIG. 16. Average strain rate sensitivity (m-value) measured for Ti-54M (FG) material at various test temperatures and strain rates.

Strain rate sensitivity (m-value) obtained for Ti-54M (FG) material at various temperatures and strain rates is given in FIG. 16. M-value tended to become higher with an increase in test temperature, although grain coarsening occurred at the higher temperature, as can be seen in FIG. 18. The test at higher strain rate of $1\times10^{-3}$/S resulted in slightly lower m-value. Overall all m-values were higher than 0.45, which satisfy a general requirement for practical superplastic forming.

Flow Stress of Ti-54M

Figure 17:
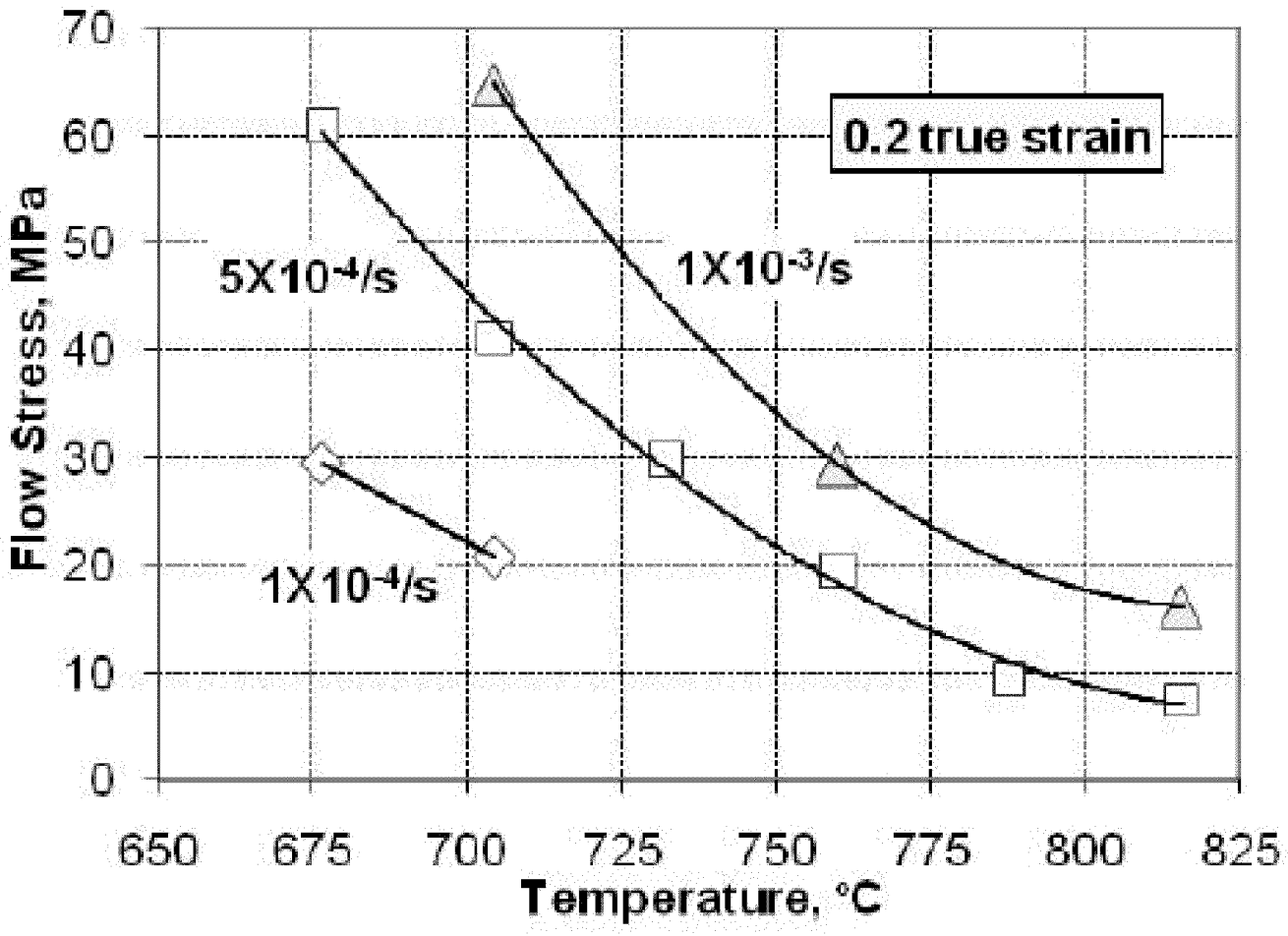
FIG. 17. Effects of temperature and stain rate on flow stress at true strain=0.2 of Ti-54M (FG) material.
Figure 18A:
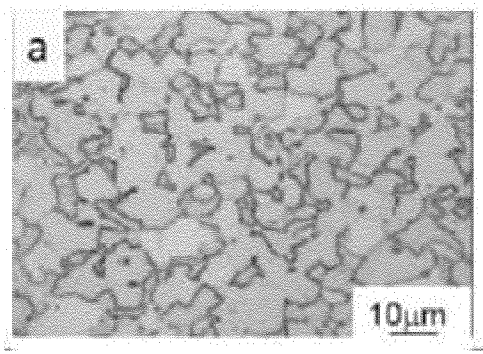
FIG. 18A. Microstructure of cross-section of reduced section after SPF coupon test, Ti-54M (SG) 1350° F. (732° C.).
Figure 18B:
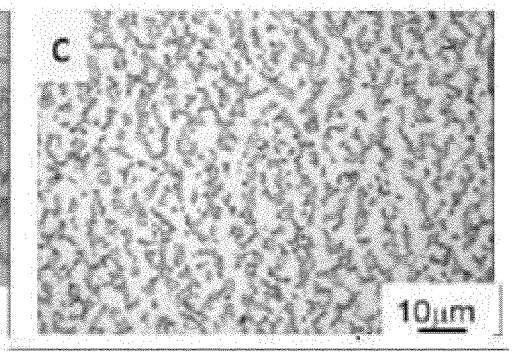
FIG. 18B. Microstructure of cross-section of reduced section after SPF coupon test, Ti-54M (SG) 1450° F. (788° C.).
Figure 18C:
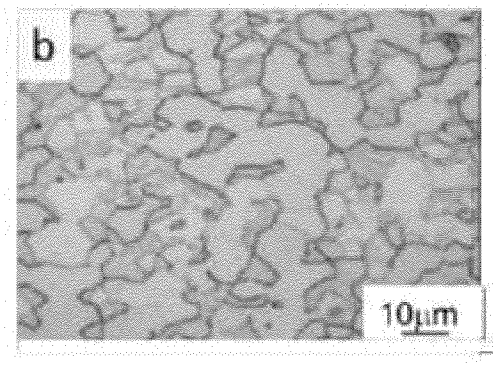
FIG. 18C. Microstructure of cross-section of reduced section after SPF coupon test, Ti-54M (FG) 1350° F. (732° C.).
Figure 18D:
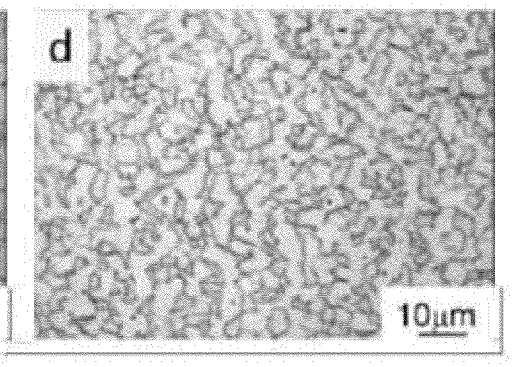
FIG. 18D. Microstructure of cross-section of reduced section after SPF coupon test, Ti-54M (FG) 1450° F. (788° C.).

Flow stress is one of the factors that limit SPF operations since the superplastic forming of higher stress materials may require operations with higher gas pressures or at higher temperatures. FIG. 17 shows the flow stress of Ti-54M (FG) sheets at a true strain of 0.2% as a function of temperature and strain rate. Flow stress of Ti-54M (FG) displayed the typical temperature and strain rate dependency as observed in other materials.

Microstructure after Superplastic Deformation

Microstructures of the reduced sections after the deformation of a true strain=1 are given in FIG. 18 for selected conditions. Some degree of dynamic coarsening was observed in both Ti-54M standard grain and fine grain sheet materials. Grain coarsening appeared to be lower in the samples tested at lower temperature. Heavily deformed grain boundaries with rounded shapes were observed after the deformation suggesting the occurrence of grain boundary sliding, which was believed to be the predominant deformation mechanism in superplastic deformation of this alloy.

Comparison of SPF Properties with Ti-6Al-4V

Figure 19:
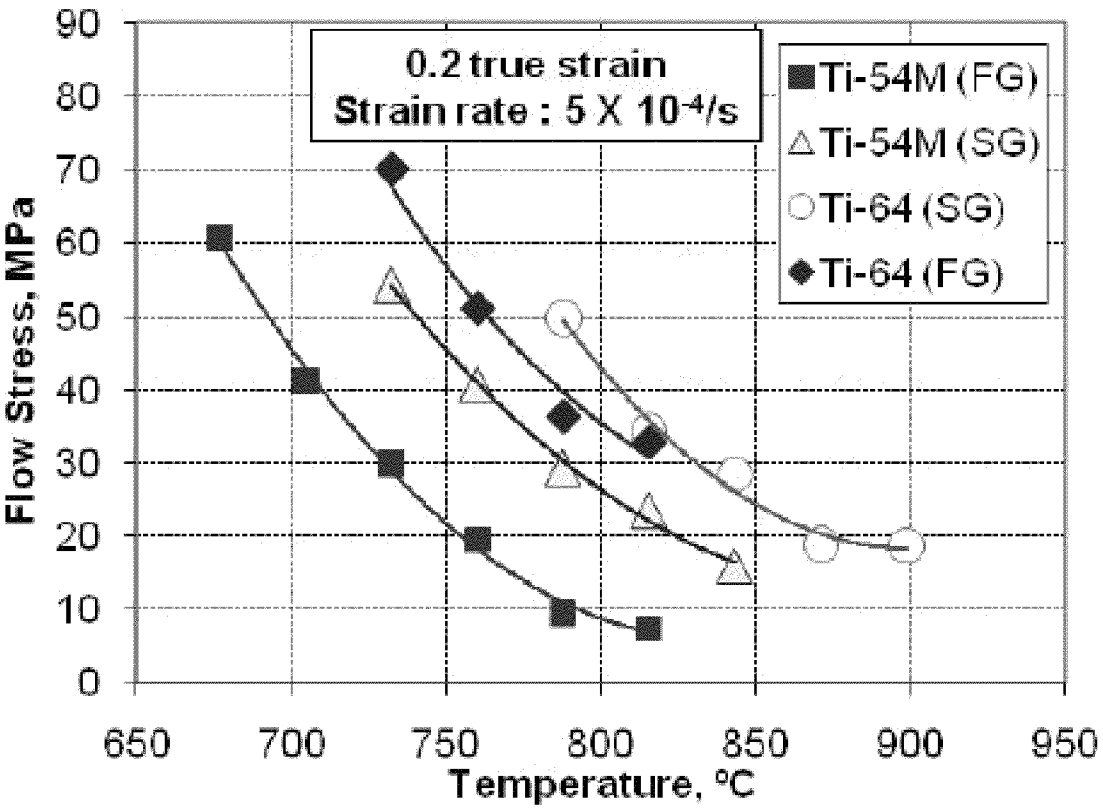
FIG. 19. Comparison of flow stress at true strain=0.2 between Ti-54M and Ti-64.

It is useful to compare SPF characteristics of Ti-54M and Ti-64, since Ti-64, being the most common alloy for SPF applications, can be considered as a baseline. FIG. 19 compares flow stress at a true strain of 0.2 for four materials. The results for Ti-64 were obtained previously[2]. As can be seen in the figure, flow stress changed by alloy and grain size as well as strain rate, which is displayed in FIG. 17. It is evident from the figure that Ti-54M exhibited lower flow stress than Ti-64 regardless of grain size. Flow stress of fine grain Ti-54M was approximately ¼ (⅓ to ⅕) of that of fine grain Ti-64, which is considered to be a significant advantage for SPF operations.

Fine grain Ti-54M material exhibited a capability of superplastic forming at temperatures as low as 700° C., which is nearly 100° C. lower than standard grain Ti-54M, and almost 200° C. lower than that of Ti-64. It is useful to discuss metallurgical factors that control superplastic forming behavior of α/β titanium alloys focusing on Ti-54M and Ti-6Al-4V.

Alloy System

Beta transus may be important for two reasons. Primary α grains tend to become smaller with decrease in β transus, since the optimum hot working temperature to manufacture alloy sheets reduces in line with β transus. The temperature that shows approximately 50%/50% of α and β phases will also be proportional to the β transus of the material. Lower SPF temperature of Ti-54M is thus due in part to the lower β transus compared with Ti-64.

Effect of Alloying Elements

Ti-54M contains elevated levels of Mo and Fe and a reduced level of Al compared with Ti-64. The addition of Mo to titanium is known to be effective for grain refinement as Mo is a slow diffuser in α and β phases. On the other hand, Fe is known to be a fast diffuser in both α and β phases[11]. Diffusivity of Fe in titanium is faster than self diffusion of Ti by an order of magnitude. A predominant mechanism of superplasticity in α/β titanium alloys is considered to be grain boundary sliding, specifically at grain boundaries of α and β grains. Dislocation climb is an important mechanism to accommodate the strains during grain boundary sliding. As dislocation climb is a thermal activation process, the diffusion of substitutional elements in β phase has a critical role in superplastic deformation. Unusually fast diffusion of Fe is believed to play an important role in accelerating diffusion in β phase, resulting in an enhanced dislocation climb in the beta phase and the activity of dislocation sources and sinks at α/β grain boundaries[11-13].

Superplasticity of Fine Grain Titanium Alloys

As demonstrated for Ti-64, finer grain size is an effective way to achieve lower temperature superplasticity[3-6]. Ultrafine grains of Ti-64, typically primary α grains finer than 1 μm, can lower the SPF temperature more than 200° C.[6]. The present work demonstrated that a similar grain size effect occurred in Ti-54M.

In addition to lowering SPF temperature in Ti-54M, lower flow stress was measured, particularly in fine grain Ti-54M. Flow stress of fine grain Ti-54M was as low as ¼ of that of fine grain Ti-64 at superplastic conditions, i.e. slow strain rate. The results indicate that grain boundary sliding of Ti-54M was easier than that of Ti-64 when other conditions are the same. Since β phase is more deformable than α phase, flow stress of β phase and mobility of α/β grain boundary may determine overall flow stress of the material. Assuming a sphere for α grain shape, a total surface area of grains can be expressed by $A=N\pi D^2$, where A is the total surface area of grains; D is a diameter of average α grains; and N is the number of grains in a unit volume. When α grain diameter is different between two materials, and two materials have different average grain sizes, $D_L$ and $D_S$, the number of α grains in a unit volume is expressed in Equation (1), where $N_L$ and $N_S$ are the number of α grains of coarse α material and finer α materials, respectively.

$$NS=(D_L/D_S)^3N_L \quad \text{(Equation 1)}$$

A total α grain boundary area, AS will be given in Equation (2).

$$AS=\pi(D_S)^2N_S=(D_L/D_S)A_L \quad \text{(Equation 2)}$$

Equation (2) shows that a total α grain boundary area is inversely proportional to α grain size. Therefore, there will be approximately 4 times of α grain boundary area that can work as sink sources of dislocations in the fine grain Ti-54M compared with standard grain Ti-54M. Significantly larger grain boundary area due to finer grain size will be responsible for lower temperature SPF and low flow stress of fine grain Ti-54M.

Practically, it is also important to consider the effect of prior thermal cycles on the grain growth of primary alpha grains prior to superplastic forming. Diffusion bonding is the most likely heat cycle the materials would receive prior to a multi-sheet superplastic forming operations[14,15] resulting in a certain amount of grain growth. Therefore, the improved superplastic performance arising from the presence of a significant amount of Fe in Ti-54M and the use of Mo to reduce grain growth results in robust SPF performance irrespective of the prior thermal cycle.

Summary

Ti-54M has superior superplastic forming properties to that of Ti-64. Fine grain Ti-54M has an SPF capability as low as 700° C.

In addition to low temperature superplasticity, fine grain Ti-54M (FG) possesses significantly lower flow stress compared with standard grain Ti-54M and Ti-64. Superior superplastic capability of Ti-54M is explained by its lower beta transus and chemical composition. Finer grain size will be an additional contributor to low temperature superplasticity.

Example 3

Ti-54M sheets were produced in the production facility using the disclosed process to produce finer grain sheets. Two sheet bars from the same heat of Ti-54M (Ti-5.07Al-4.03V-0.74Mo-0.53Fe-0.160) were used for the manufacture of 0.180" and 0.100" gage sheets. One sheet bar from other heat of Ti-54M (Ti-5.10Al-4.04V-0.77Mo-0.52Fe-0.150) was used for producing the 0.040" gage sheet material. All sheet bars were beta quenched followed by subsequent rolling operations to the final sheet gage. The sheets were then ground and pickled to remove any alpha case or oxide layer. Detailed process procedure is presented in Table 3.

TABLE 6

Manufacturing process and particle size measurements of fine grain Ti-54M sheets produced in the production facility.

| Item | Operation | 0.180" gage | 0.100" gage | 0.040" gage |
|---|---|---|---|---|
| Manufacturing Process | Sheet bar thickness, in | 0.964 | 0.825 | 0.64 |
| | Beta Quench | 1920 F./20 min/WQ | 1920 F./20 min/WQ | 1920 F./20 min/WQ |
| | Rolling Temp, F. | 1500 | 1500 | 1500 |
| | Intermediate gage, in | 0.550 | 0.335 | 0.180 |
| | Reduction, % | 42.9 | 59.4 | 71.9 |
| | Steel Pack | No | Yes | Yes |
| | Cross rolling temp, F. | 1500 | 1500 | 1500 |
| | Final Gage, in | 0.200 | 0.120 | 0.060 |
| | Reduction, % | 63.6 | 64.2 | 66.7 |
| | Final gage anneal condition | 1350 F./1 hr/AC | 1350 F./1 hr/AC | 1350 F./1 hr/AC |
| | Final gage after grind and pickle, in | 0.180 | 0.100 | 0.040 |
| Microstructure Results | Volume Fraction Alpha, % | 57.5 | 46.3 | 69.0 |
| | Alpha Particle Size, μm | 2.0 | 2.4 | 5.0 |

Figure 20A:
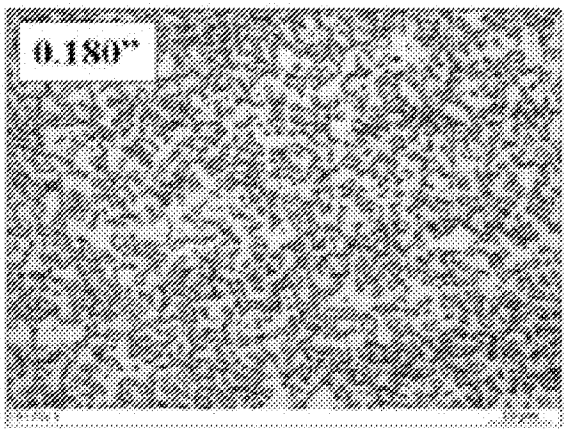
FIG. 20A. Microstructure of the fine grain Ti-54M materials. Average alpha particle size was determined to be 2.0 μm on the 0.180" gage sheet.
Figure 20B:
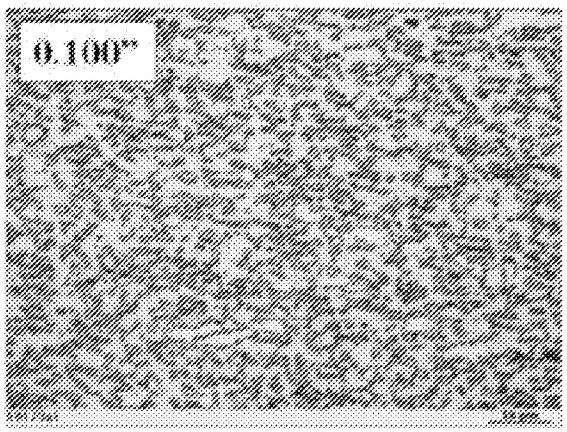
FIG. 20B. Microstructure of the fine grain Ti-54M materials. Average alpha particle size was determined to be 2.4 μm on the 0.100" gage sheet.
Figure 20C:
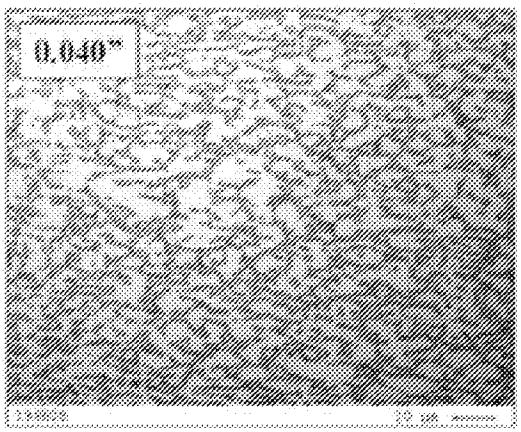
FIG. 20C. Microstructure of the fine grain Ti-54M materials. Average alpha particle size was determined to be 4.9 μm on the 0.040" gage sheet.

The resulting microstructure from the final gage material is shown in FIG. 20. Volume Fraction Alpha (VFA) was measured by systematic manual point count in accordance to ASTM E562 and the average alpha particle size was determined according to ASTM E112. Room temperature tensile tests on both gage materials were performed using sub-size tensile specimens in accordance to ASTM E8 and are presented in Table 7.

TABLE 7

Room temperature tensile properties of fine grain sheets.

| Gage, in | Orientation | YS, ksi | UTS, ksi | El, % |
|---|---|---|---|---|
| 0.180 | L | 134.3 | 141.5 | 21.1 |
| | T | 137.4 | 141.5 | 17.2 |
| 0.100 | L | 136.9 | 142.7 | 19.3 |
| | T | 136.8 | 141.9 | 17.0 |
| 0.040 | L | 131.2 | 137.1 | 13.9 |
| | T | 128.4 | 136.6 | 13.1 |

Figure 21:
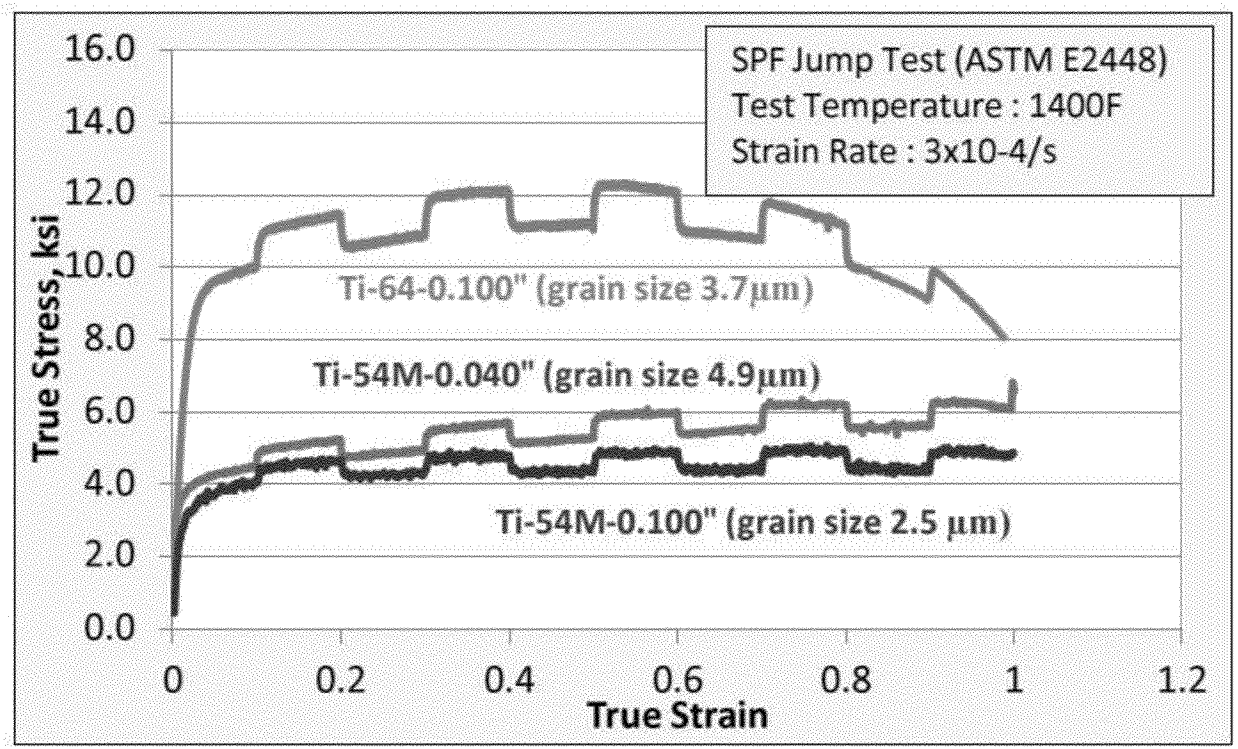
FIG. 21. Flow curves obtained by jump strain rate test showing significantly lower and stable flow stress for Ti-54M processed according to an embodiment disclosed herein compared with Ti-64.

FIG. 21 compares flow curves obtained by SPF jump strain rate tests. The test was performed at 1400° F. at $3\times10^{-4}$/S. The results indicate that Ti-54M sheets processed with the current invention show equivalent flow curves. Also Ti-54M sheets show significantly lower flow stress than that of Ti-64.

Example 4

Ti-54M (Ti-4.91Al-3.97V-0.51Mo-0.45Fe-0.150) sheet bar of 0.25" thick was used for making fine grain sheets in a laboratory at three different rolling temperatures as shown in Table 8. Each final gage sheet is annealed at three different temperatures to determine the optimum rolling-annealing condition for the manufacture of Ti-54M fine grain sheets. Metallography samples were excised off of each sheet and average alpha size estimated according to ASTM standards.

TABLE 8

Processing history for the production of Ti-54M sheets.

| Item | Operation | Process I | Process II | Process III |
|---|---|---|---|---|
| Manufacturing Process | Sheet bar thickness, in | 0.250 | 0.250 | 0.250 |
| | Beta Quench | 1850 F./25 min/WQ | 1850 F./25 min/WQ | 1850 F./25 min/WQ |
| | Rolling temp, F. | 1450 | 1550 | 1650 |
| | Intermediate gage, in | 0.125 | 0.125 | 0.125 |
| | Reduction, % | 50.0 | 50.0 | 50.0 |
| | Steel pack | Yes | Yes | Yes |
| | Cross rolling temp, F. | 1450 | 1550 | 1650 |
| | Final gage, in | 0.065 | 0.065 | 0.065 |
| | Reduction, % | 48.0 | 48.0 | 48.0 |
| | Final gage anneal temperature, F. | 1350, 1450, 1550 | 1350, 1450, 1550 | 1350, 1450, 1550 |

FIGS. 22, 23 and 24 show the microstructure of each sheet after being processed according to different conditions as shown in Table 8.

Figure 22A:
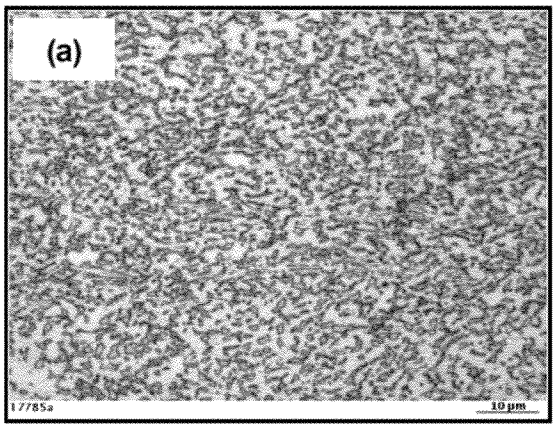
FIG. 22A. Microstructure observed on Ti-54M sheet rolled at 1450° F. (788° C.) and annealed at 1350° F. (732° C.).
Figure 22B:
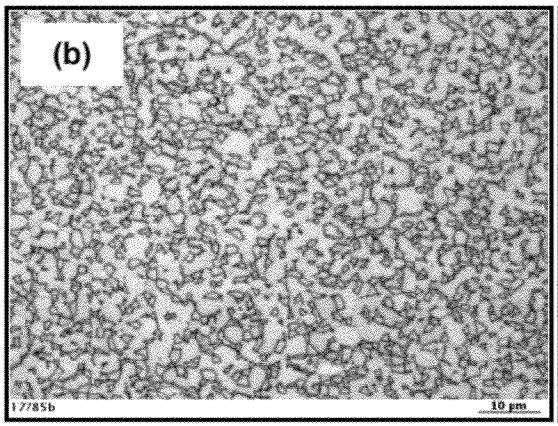
FIG. 22B. Microstructure observed on Ti-54M sheet rolled at 1450° F. (788° C.) and annealed at 1450° F. (788° C.).
Figure 22C:
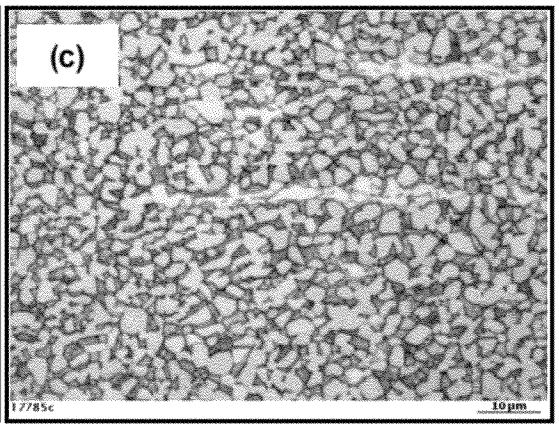
FIG. 22C. Microstructure observed on Ti-54M sheet rolled at 1450° F. (788° C.) and annealed at 1550° F. (843° C.).

FIG. 22A shows the microstructures observed for Ti-54M sheets rolled at 1450° F. and annealed at 1350° F. (FIG. 22A), 1450° F. (FIG. 22B), and 1550° F. (FIG. 22C), according to Process I in Table 8. It is noted that the rolling temperature of each sheet was performed within the disclosed range (1400° F.-1550° F.) and the annealing temperatures span the disclosed range (1300° F.-1550° F.). FIG. 22A, shows the microstructure of an alloy that was processed using rolling and annealing temperatures that fall within the disclosed ranges. This alloy has a grain size of 2.0 μm. FIG. 22B, also shows the microstructure of an alloy that was processed using rolling and annealing temperatures that fall within the disclosed ranges. This alloy has a grain size of 2.2 μm. FIG. 22C, shows the microstructure of an alloy that was processed using rolling and annealing temperatures that fall within the disclosed ranges, but the annealing temperature was at the upper temperature limit. This alloy has a grain size of 2.4 μm. Therefore, according to the results shown in FIG. 22, increasing the annealing temperature, while maintaining the rolling temperature, results in an increase in grain size.

Figure 23A:
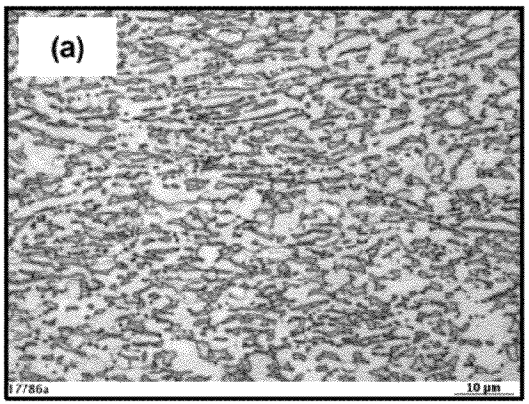
FIG. 23A. Microstructure observed on Ti-54M sheet rolled at 1550° F. (843° C.) and annealed at 1350° F. (732° C.).
Figure 23B:
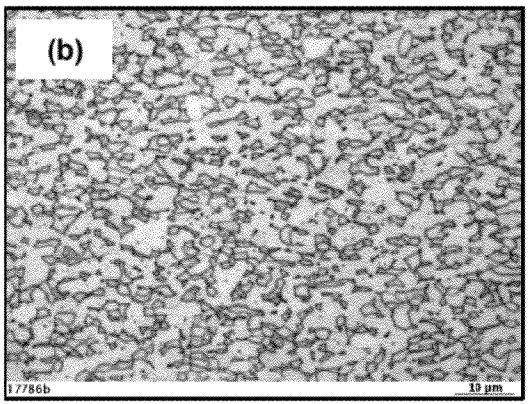
FIG. 23B. Microstructure observed on Ti-54M sheet rolled at 1550° F. (843° C.) and annealed at 1450° F. (788° C.).
Figure 23C:
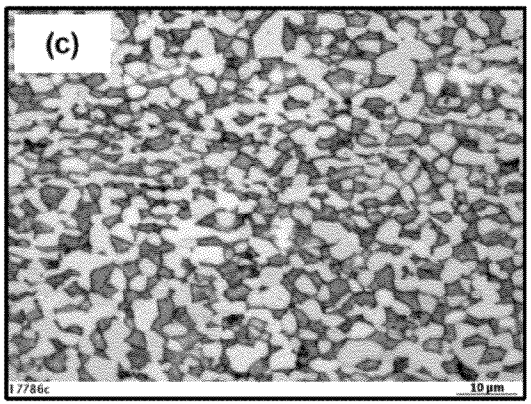
FIG. 23C. Microstructure observed on Ti-54M sheet rolled at 1550° F. (843° C.) and annealed at 1550° F. (843° C.).

FIG. 23 shows microstructures observed on Ti-54M sheets rolled at 1550° F. and annealed at 1350° F. (FIG. 23A), 1450° F. (FIG. 23B), and 1550° F. (FIG. 23C), according to Process II in Table 8. It is noted that the rolling temperature of each sheet was performed at the upper temperature limit the disclosed range (1400° F.-1550° F.) and the annealing temperatures span the disclosed range (1300° F.-1550° F.). FIG. 23A, shows the microstructure of an alloy that was processed using the upper limit for the rolling temperature and an annealing temperature that falls within the disclosed range. This alloy has a grain size of 2.4 μm. FIG. 23B, shows the microstructure of an alloy that was processed using the upper limit for the rolling temperature and an annealing temperature that falls within the disclosed range. This alloy has a grain size of 2.6 μm. FIG. 23C, shows the microstructure of an alloy that was processed using rolling and annealing temperatures that both fall at the upper limit of the disclosed ranges. This alloy has a grain size of 3.1 μm. Therefore, according to the results shown in FIG. 23, increasing the annealing temperature, while maintaining the rolling temperature, results in an increase in grain size.

Figure 24A:
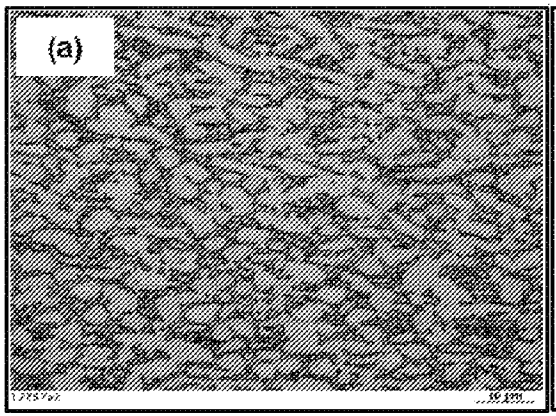
FIG. 24A. Microstructure observed on Ti-54M sheet rolled at 1650° F. (899° C.) and annealed at 1350° F. (732° C.).
Figure 24B:
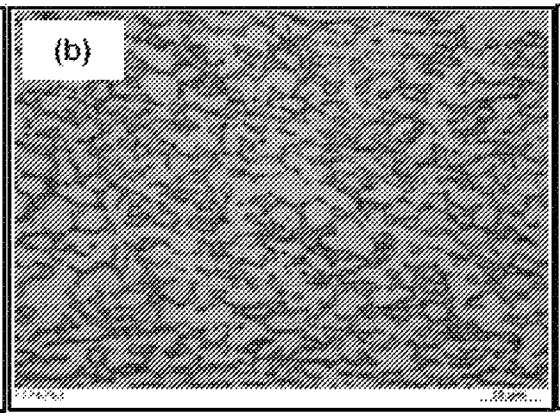
FIG. 24B. Microstructure observed on Ti-54M sheet rolled at 1650° F. (899° C.) and annealed at 1450° F. (788° C.).
Figure 24C:
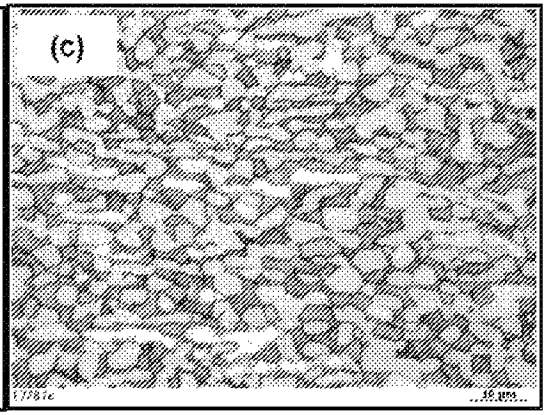
FIG. 24C. Microstructure observed on Ti-54M sheet rolled at 1650° F. (899° C.) and annealed at 1550° F. (843° C.).

Finally, FIG. 24 shows microstructures observed on Ti-54M sheets rolled at 1650° F. and annealed at 1350° F. (FIG. 24A), 1450° F. (FIG. 24B), and 1550° F. (FIG. 24C), according to Process III in Table 8. It is noted that the rolling temperature of each sheet was performed above (outside) the temperature limit the disclosed range (1400° F.-1550° F.) and the annealing temperatures span the disclosed range (1300° F.-1550° F.). FIG. 24A, shows the microstructure of an alloy that was processed using a rolling temperature outside the disclosed range and an annealing temperature that falls within the disclosed range. This alloy has a grain size of 3.5 μm. FIG. 24B, shows the microstructure of an alloy that was processed using a rolling temperature outside the disclosed range and an annealing temperature that falls within the disclosed range. This alloy has a grain size of 3.6 μm. FIG. 24C, shows the microstructure of an alloy that was processed using a rolling temperature outside the disclosed range and annealing temperature at the upper limit of the disclosed ranges. This alloy has a grain size of 3.7 μm. Therefore, according to the results shown in FIG. 23, increasing the annealing temperature, while maintaining the rolling temperature, results in an increase in grain size.

Additionally, comparing FIGS. 22, 23, and 24, it is apparent that increasing either the rolling temperature or the annealing temperature results in an increase in the grain size.

Figure 25:
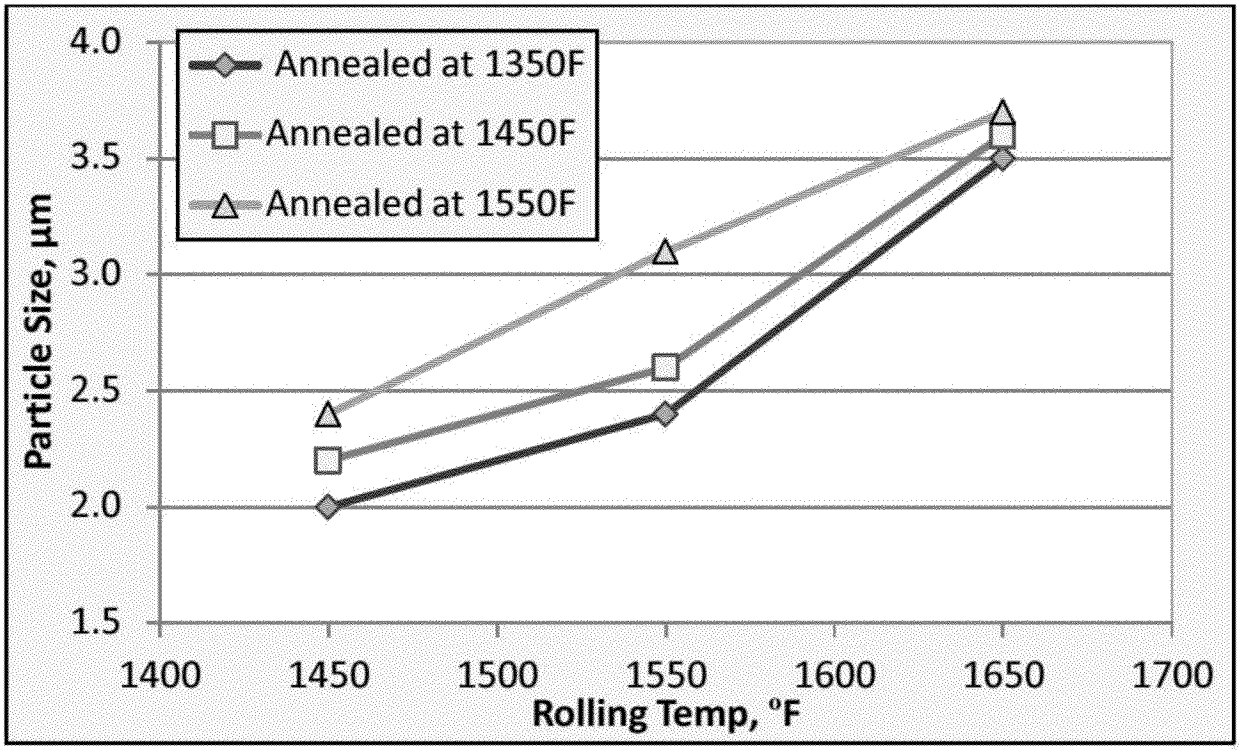
FIG. 25. Graph showing the relationship between the alpha particle size and rolling temperature.

It appears to be the general trend that as the rolling temperature and/or the annealing temperature is increased, average alpha grains coarsen. FIG. 25 shows the change of alpha particle size by processing condition. Particle size of this example is finer than those materials in Example 3 as the process was performed in a laboratory scale starting from thin sheet bar. FIG. 25 indicates that finer grains are obtained when rolling temperature is low. However, there will be a limitation for lowering rolling temperature as material becomes harder as temperature decreases which may exceed the mill load in a practical operation.

Example 5

Figure 26:
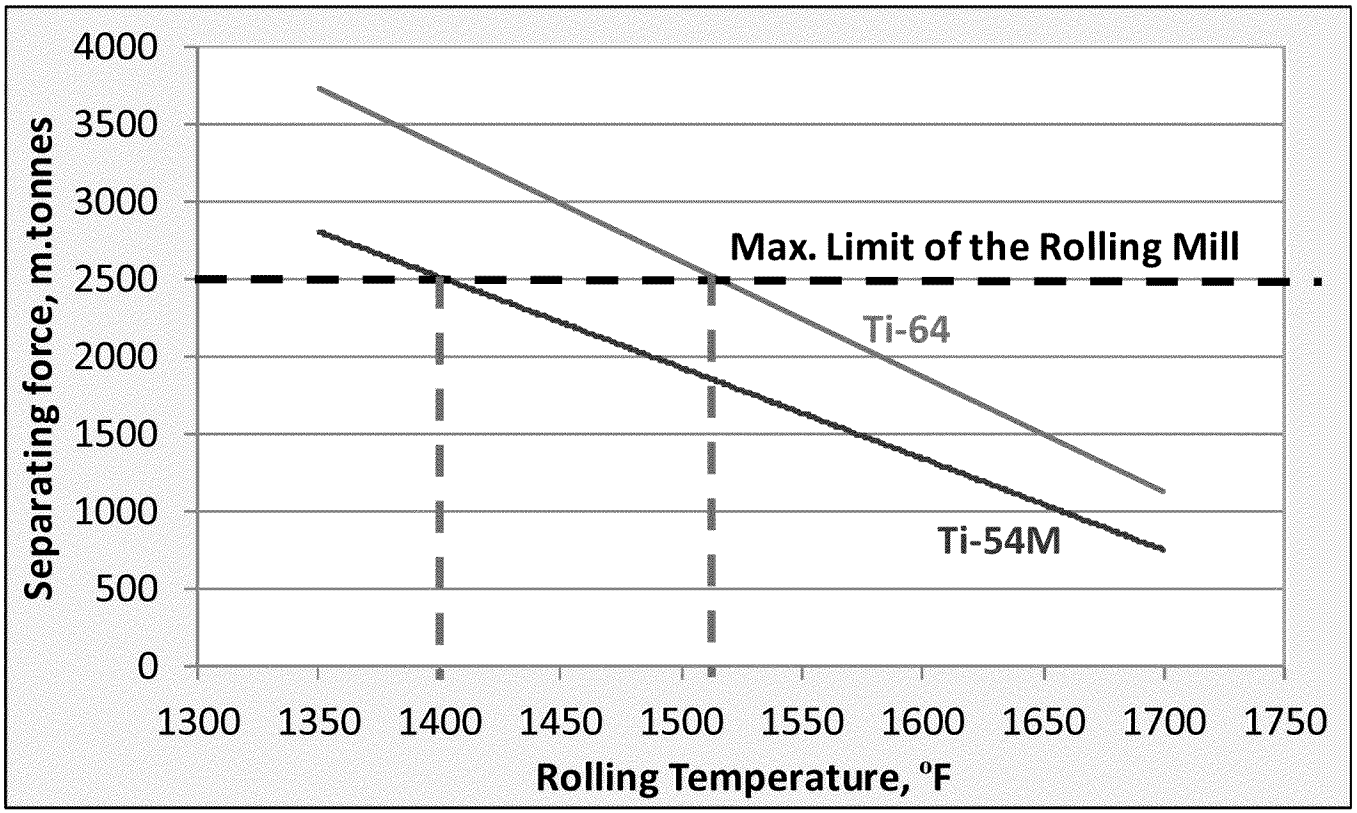
FIG. 26. Graph showing the relationship between mill separating forces and rolling temperature.

To exemplify the benefits of Ti-54M over Ti-64 and the present invention over the prior art, a process simulation was performed using measured flow stress of two materials (Ti-54M and Ti-64) that are geometrically same dimensions and rolled on a mill whose maximum limit on separating forces is 2500 m. tonnes. FIG. 26 shows a clear difference between the separating forces required to roll these two materials.

FIG. 26 shows that the Ti-54M sample can be rolled on a mill with relatively lower separating forces, thus providing huge advantages in the selection of rolling mills and the size of materials. Additionally, it is evident from FIG. 26 that Ti-54M can be rolled easily at temperature as low as 1400° F. without causing any damage to the rolling mill that has a maximum separating force of 2500 m. tonnes. However, the rolling temperature needs to be higher than 1500° F. for successful rolling of Ti-64.

It is evident that separating forces on the rolling mill will increase to unusually high values with lower rolling temperatures, such as temperatures below 1400° F. Therefore, a rolling mill with very high capacities would be required to perform rolling at such low temperatures.

It will be appreciated by persons skilled in the art that the present invention is not limited to what has been particularly shown and described in this specification. Rather, the scope of the present invention is defined by the claims which follow. It should further be understood that the above description is only representative of illustrative examples of embodiments. For the reader's convenience, the above description has focused on a representative sample of possible embodiments, a sample that teaches the principles of the present invention. Other embodiments may result from a different combination of portions of different embodiments.

The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent. Furthermore, all references, publications, U.S. patents, and U.S. Patent Application Publications cited throughout this specification are incorporated by reference as if fully set forth in this specification.

It should be understood that all elemental/compositional percentages (%) are in "weight percent". Also, it should be understood that the term "inches" has been abbreviated with the quote symbol (") throughout the application.

The invention claimed is:

1. A method of producing fine grain Ti-5Al-4V-0.6Mo-0.4Fe sheets through a hot rolling process comprising, a. forging Ti-5Al-4V-0.6Mo-0.4Fe slab to sheet bar, intermediate gage of plates;

b. heating the sheet bar to a temperature between about 100° F. to about 250° F. higher than beta transus for about 15 to about 30 minutes followed by cooling;

c. heating the sheet bar to a temperature between about 1450° F. to about 1500° F. then hot rolling to an intermediate gage;

d. heating the intermediate gage to a temperature between about 1450° F. to about 1500° F. then hot rolling to a final gage;

e. annealing the final gage to a temperature between about 1350° F. to about 1500° F. for about 30 min to about 1 hour followed by cooling; and f. grinding the annealed gage with a sheet grinder followed by pickling to remove oxides and alpha case formed during thermo-mechanical processing.

2. The method of claim 1, wherein the sheet bar of step a has a thickness from about 0.2" to about 1.5" depending on the finish sheet gages.

3. The method of claim 1, wherein the cooling step b is performed by fan air cooling or faster.

4. The method of claim 1, wherein the hot rolling of step c has a total reduction controlled between about 40% to about 80%.

5. The method of claim 1, wherein the reduction is defined as (Ho−Hf)/Ho*100, wherein Ho is the gage of input plate and Hf is a gage of finished gage.

6. The method of claim 1, wherein the hot rolling of step d is performed with a rolling direction perpendicular to the rolling direction of step c.

7. The method of claim 1, wherein the hot rolling step of d has a total reduction controlled between about 40% to about 75%.

8. The method of claim 7, wherein the reduction is defined as (Ho−Hf)/Ho*100, wherein Ho is the gage of input plate and Hf is a gage of finished gage.

9. The method of claim 1, wherein the hot rolling of step d utilizes a steel pack in order to avoid excessive heat loss during rolling.

10. The method of claim 1, wherein the cooling of step e is performed at air atmosphere.

* * * * *